United States Patent [19]

Horn, deceased et al.

[11] Patent Number: 4,709,574

[45] Date of Patent: Dec. 1, 1987

[54] MACHINE FOR COLD FORMING SMALL TUBULAR ELEMENTS

[75] Inventors: Charles Horn, deceased, late of Dayton, by Dorothy E. Horn, executor; William R. Jenkins, Dayton, both of Ohio

[73] Assignee: Vulcan Tool Company, Dayton, Ohio

[21] Appl. No.: 585,763

[22] Filed: Mar. 2, 1984

[51] Int. Cl.[4] ..... B21J 13/08; B21K 1/64

[52] U.S. Cl. ..... 72/405; 72/354; 72/356; 72/361; 72/422; 10/76 T; 10/165; 10/169

[58] Field of Search ..... 72/405, 422, 333, 341, 72/354, 356, 419, 361; 10/76 T, 76 R, 166, 169, 165, 12 T

[56] References Cited

U.S. PATENT DOCUMENTS

| | | | |
|---|---|---|---|
| 2,132,244 | 10/1938 | Richard | 10/12 T |
| 2,711,550 | 6/1955 | Nielsen | 10/169 |
| 2,834,258 | 5/1958 | Anderson et al. | 10/166 |
| 3,011,464 | 12/1961 | Danly et al. | 72/422 |
| 3,154,801 | 11/1964 | Byam | 10/12 T |
| 3,183,532 | 5/1965 | Kull | 10/12 T |
| 3,183,533 | 5/1965 | Kull | 72/419 |
| 3,491,576 | 1/1970 | Oguri et al. | 72/356 |
| 3,525,248 | 8/1970 | Schulte et al. | 72/405 |
| 3,633,766 | 1/1972 | Byam | 72/422 |
| 3,688,717 | 9/1972 | Rudolph et al. | 72/356 |
| 3,800,583 | 4/1974 | Miller | 72/361 |

FOREIGN PATENT DOCUMENTS

| | | | |
|---|---|---|---|
| 523310 | 3/1956 | Canada | 72/405 |

*Primary Examiner*—Daniel C. Crane
*Attorney, Agent, or Firm*—Jerome P. Bloom

[57] ABSTRACT

Apparatus for converting short tubular elements into nuts, fittings, sleeves, or other annular fasteners or couplers comprises means defining a plurality of stations including a receiving station and a plurality of working stations. Each tubular element must be positioned in each station in the course of its conversion. The receiving station is constructed to establish a predetermined orientation of each tube received thereby. Mechanism is provided for automatic and successive transfer of the tube elements from the receiving to the following stations, in series relation. Tooling is provided in essentially coaxial alignment with each of the tube elements at each working station. The tooling in each working station is arranged to apply endwise of the tool element in the path thereof and/or, at least in part, along the length and axially thereof to produce a change in configuration and/or dimension of at least a part of the tube element while maintaining its originally provided interior cross section along at least a portion of its length. The transfer mechanism is normally displaced from the receiving and working stations and includes means for engaging tubular elements simultaneously in each of a plurality of stations and to simultaneously carry each engaged tube element from one to the next following stations in each repetitive cycle of its movement. Cycling of the tube elements from one to another station is effected in a rapid and precise substantially linear pattern of movement.

8 Claims, 24 Drawing Figures

MACHINE FOR COLD FORMING SMALL TUBULAR ELEMENTS

BACKGROUND OF THE INVENTION

This invention relates to improvements in means and methods for fabricating annular or tubular fittings, sleeve-type connectors and fasteners, especially those having the character of nuts. Such devices are often characterized by the need for having specially configured portions of their exterior surface as well as surface threading. This is particularly true of nuts which require a plurality of circumferentially spaced flats on their outer peripheral surface to facilitate their manipulation to obtain their secure application as well as to provide a base facilitating their removal and/or disengagement from the elements to which they apply. Since the invention is particularly advantageous in application to the production of nut type connectors and fasteners, the invention will be herein illustrated with reference to an embodiment for use in making cap nuts.

Nuts heretofore have generally been fabricated from bar stock in a procedure which has frequently produced an end product less than satisfactory as to its dimension and form. More than this, its fabrication has often demanded not only a series of time consuming and costly difficult and power-consuming machining steps but the use of expensive stock, such as hex and other specially shaped bar stock.

The present invention essentially eliminates the above mentioned problems and difficulties which have for many, many years plagued those engaged in the fabrication and use of nut type connectors. It affords, moreover, a concept of fabrication and apparatus to achieve the same which not only features the use of comparatively inexpensive tubing as the basic stock from which nuts are formed but also provides for a simple precision forming, shaving and tapping of tubing by means of which a large variety of nuts may be produced relatively inexpensively in an extremely short period of time.

In general and specifically the present invention enables a machine for and process of fabrication of annular or tubular fasteners and connector devices having the characteristics of nuts which are more economical to employ, more efficient and satisfactory in use, and adaptable to a wide variety of applications. Most importantly, the invention provides that the end products resulting can be easily and more precisely controlled as to their desired dimension and configuration.

As far as the inventors are aware, there have been previous efforts to use tubular stock for the fabrication of nuts but without particular success. The concept involved in such efforts required that tubing be squeezed to produce a hex or comparable shape on its outer peripheral surface. The efforts apparently failed because the result of the squeezing was to produce an out-of-round condition of the inner diameter of the tubing, obviously negating its use for the end product desired.

SUMMARY OF THE INVENTION

The present invention provides apparatus for and a method of easily and rapidly forming, shaving and/or cutting individual tubular elements, which are in fact each a very short section of a length of stock tubing, to produce a desired configuration of their outer peripheral surface while maintaining critical portions of the length of their inner surface concentric to their longitudinal axis. The invention further provides apparatus for and a method of maintaining the inner diameter of stock tubing true, to whatever extent required, while simply and quickly producing whatever configuration may be desired on its outer surface, and provides as well, where required, for a subsequent simple tapping or otherwise threading of the tubing in a relatively precise fashion facilitated by transfer means the nature and character of which presents the material being worked in essentially the same attitude for each step in the working thereof, thereby to insure that the precision of the threading then depends only on the positioning of the tubing to produce thereon the required thread.

The invention enables considerable versatility in its use, since it provides that the outer peripheral surface of the tubular elements used as the basic stock may be worked independently of and without affecting their inner diameter as and to the extent desired. Moreover, the embodiments thereof can be applied to extremely short lengths of tubing.

Apparatus improvements of the invention are herein illustrated in a preferred embodiment and as embodied in a press. Such apparatus comprises means defining a receiving station to which the basic raw material to be worked is delivered. In this case the basic stock comprises short lengths of tubing, each of which constitutes a very short tube element. The tube elements are moved into the receiving station one at a time and in rapid succession. At this point each tube element, as it arrives, is placed under the control of an automatically operating transfer mechanism which, once energized, functions to repetitively cycle through a generally horizontal rectangular path in the process of which to successively move the tube element through a plurality of series related following stations, the tube element being advanced one station in the course of each cycle of the transfer mechanism. As will be seen, the construction and arrangement of the apparatus is such that a plurality of tube elements are being worked at any given time.

In the embodiment illustrated the course of movement of the tube elements per se is maintained in an essentially straight line path and during their movement from station to station and within each station the tube elements are maintained so that their longitudinal axis is essentially at a right angle to such path. This insures that upon its arrival at each working station each tube element is positioned in a coaxial alignment with the tool by which it is worked, by virtue of which its open ends respectively face the ram and the bed of the press in which the apparatus is embodied so that the forming of the tube element may be achieved utilizing endwise application thereto of compressive and/or shear forces and the threading thereof, if required, is facilitated.

For the forming of a nut the tooling required is simple and defines forming, shaving and tapping stations in each of which there is a direct coaxial relation of the tools and/or dies and the worked material which is positioned therebetween by the transfer mechanism. The arrangement enables a press with a capability of converting large quantities of very short lengths of relatively inexpensive stock tubing into the required configuration of a nut-type connector or fastener exhibiting the properties and characteristics of a good precision formed product within relatively short periods of time and at minimal cost for such products.

A primary object of the invention is to provide new and improved apparatus for the high speed production of nuts, fittings, sleeve-type connectors and fasteners from short lengths of tubing which is relatively economical to fabricate, most efficient and satisfactory in use, adaptable to a wide variety of applications and unlikely to malfunction.

A further object is to provide new and improved apparatus for rapidly and automatically converting short lengths of tubing into nuts, fittings and sleeve-type connectors and fasteners which have the characteristics and properties of precisely formed articles.

Another object is to provide a new and improved method of and means for producing nuts, fittings and various annular or sleeve-type connectors and fasteners from short lengths of metal tubing which significantly reduce the time of fabrication and unit cost of such articles.

An additional object of the invention is to provide new and improved machinery capable of high speed production of nuts and various annular, sleeve or cap-type fasteners or connectors, characterized by screw threads.

Another object is to provide an improved method of and means for a high speed, substantially precision fabrication of nuts, fittings and sleeve-type connectors and fasteners from short lengths of tubing which provides for the application of compressive force to each of the short lengths of tubing to establish the general configuration thereof, the shaving of outer surface portions of the tubing to produce thereon the means required for its manipulation and, subsequently, the production thereon of such surface threading as may be required.

A further object of the invention is to provide new and improved machinery capable of a high speed production of nuts and various annular, sleeve or cap-type fasteners or connectors, particularly those characterized by screw threads, utilizing short lengths of tubing as the basic stock from which said articles are produced, featuring an automatically cycling transfer mechanism which intermittently and rapidly advances each short length of tubing from one station to another and in each successive working station presents such tubing in essentially the same orientation. An additional object is to provide such apparatus wherein the working stations are respectively defined by forming, cutting and, where required, thread forming tools which have a coaxial relation to the stock in the working thereof, thereby facilitating the rapid production of essentially precision formed end products which are economical to fabricate and highly satisfactory and easy to use for their intended application.

Another object of the invention is to provide new and improved apparatus for making nuts, fittings and sleeve-type connectors and fasteners from short lengths of tubing possessing the advantageous structural features, the inherent meritorious characteristics and the means and mode of application such as herein described.

A further object of the invention is to provide a new and improved method of producing nuts, fittings and sleeve-type connectors and fasteners from short lengths of tubing possessing the advantageous features and inherent meritorious characteristics herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein one but not necessarily the only form of embodiment of the invention is illustrated, FIG. 1 is a perspective view of a press which embodies apparatus in accordance with the present invention;

Like parts are indicated by similar characters of reference throughout the several views.

It is to be understood that only such detail of the press, the embodied apparatus and the controls employed are herein disclosed as may be necessary for an understanding of the present invention. Such details as are not disclosed may be conventionally executed in various fashion by experts in the pertinent fields of endeavor, once given the parameters, details and function herein set forth.

It is also to be understood that the drawings are generally diagrammatic in character and that parts thereof have in some cases been eliminated or displaced for clarity of disclosure. Nevertheless, sufficient detail is shown and described to enable practice of the present invention by one versed in the art.

Figure 1:
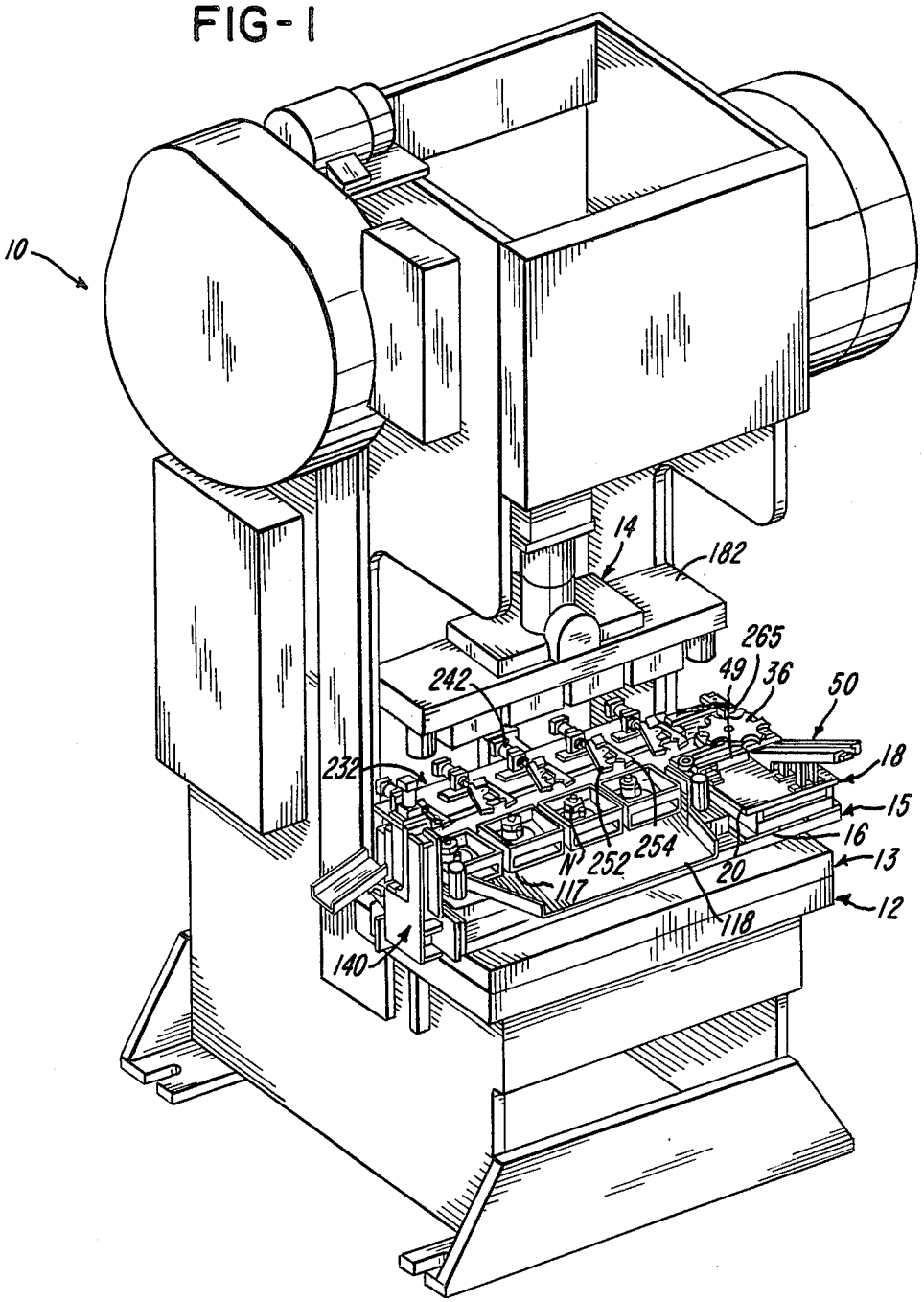

As shown in FIG. 1 of the drawings, a punch press 10 includes a horizontal bed plate 12, superposed on and anchored to which is a bolster 13. Spaced vertically above and centered with reference to the bolster is a ram 14. A plate 15 is anchored to and extends laterally across the upper surface of the bolster 13 from its left side edge to and a short distance beyond its right side edge. As viewed in front elevation, the extreme right hand portion of the upper surface of the plate 15 mounts a superstructure 18 the base 16 of which is secured thereto. The top of the structure 18 is defined by a plate 20, the horizontally disposed upper surface of which is spaced vertically from and parallel to the underlying bolster. The superstructure 18 also embodies a plurality of vertically oriented edge mounted plates which are welded at their upper edge to the plate 20 and at their lower edge to the base 16 and at right angles to one another.

Figure 4A:
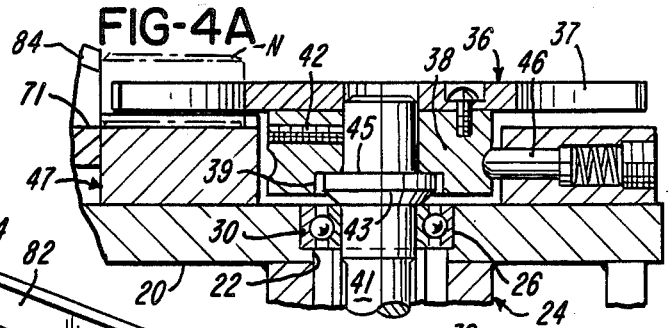
FIG. 4A is an enlargement of a portion of FIG. 4.
Figure 4:
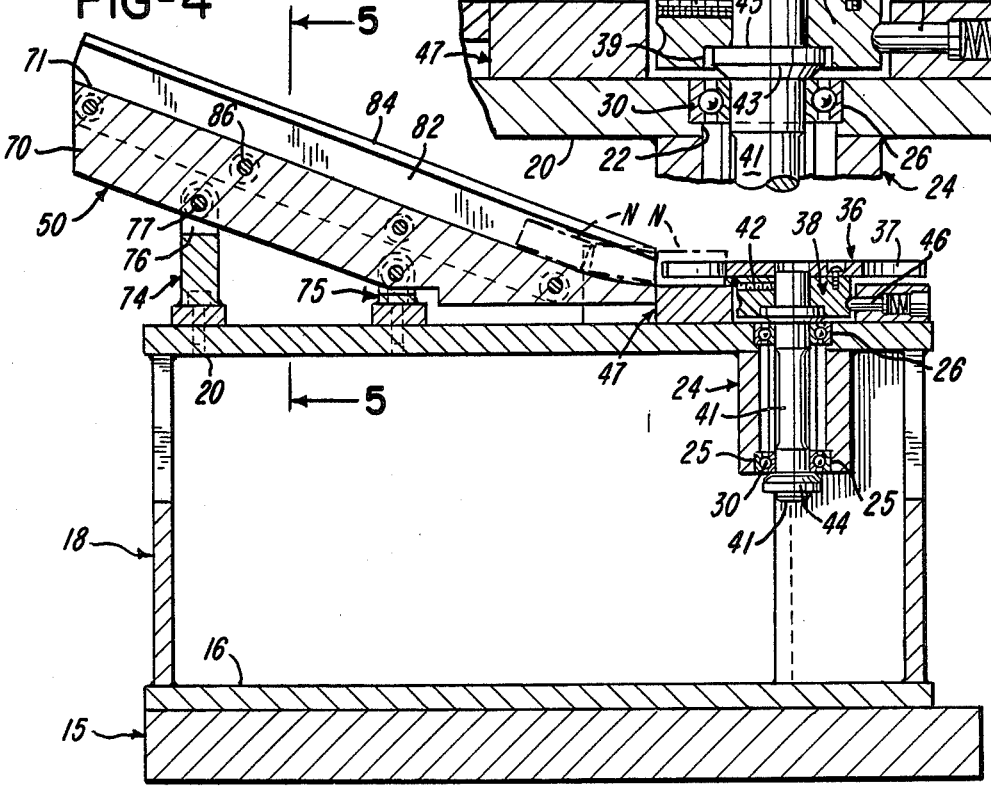
FIG. 4 is a sectional view taken on line 4—4 of FIG. 2.
Figure 5:
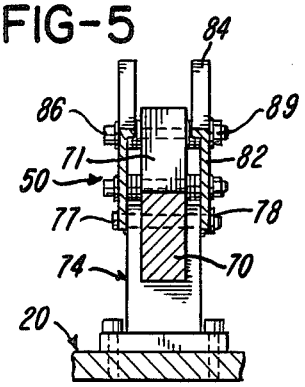
FIG. 5 is a sectional view taken on line 5—5 of FIG. 4.
Figure 6:
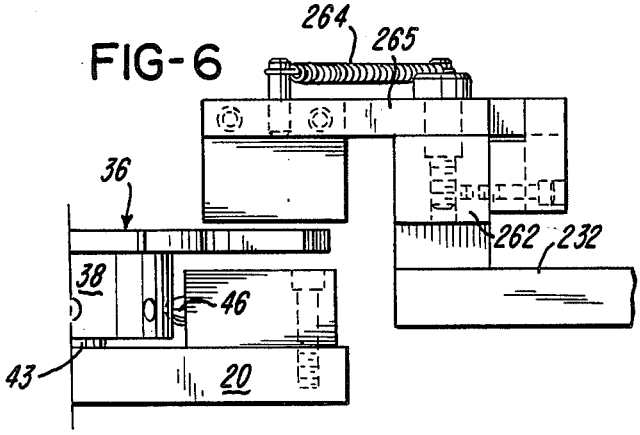
FIG. 6 is a sectional view taken on line 6—6 of FIG. 2.
Figure 8:
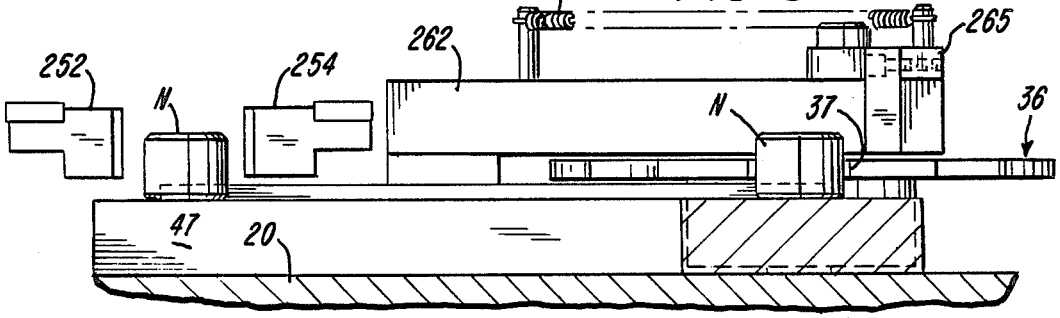
FIG. 8 is a sectional view taken on line 8—8 of FIG. 7.

In the vicinity of the right rear corner thereof, as seen in FIGS. 4 and 4A the plate 20 has an aperture 22 which is axially extended in a downward direction by a vertically dependent coaxial tubular element 24 the uppermost end of which is abutted and welded to the undersurface of the plate 20 in rimming relation to the aperture 22. The aperture 22 and the interior wall surface of the element 24 define a through passage having a uniform cross section except for its uppermost end which is expanded by a counterbore 26 and its lowermost end by a counterbore 25. A ball bearing unit 30 nested in the counterbore 26 has its outer race seated to the base of the counterbore and peripherally bearing on its side wall.

Figure 2:
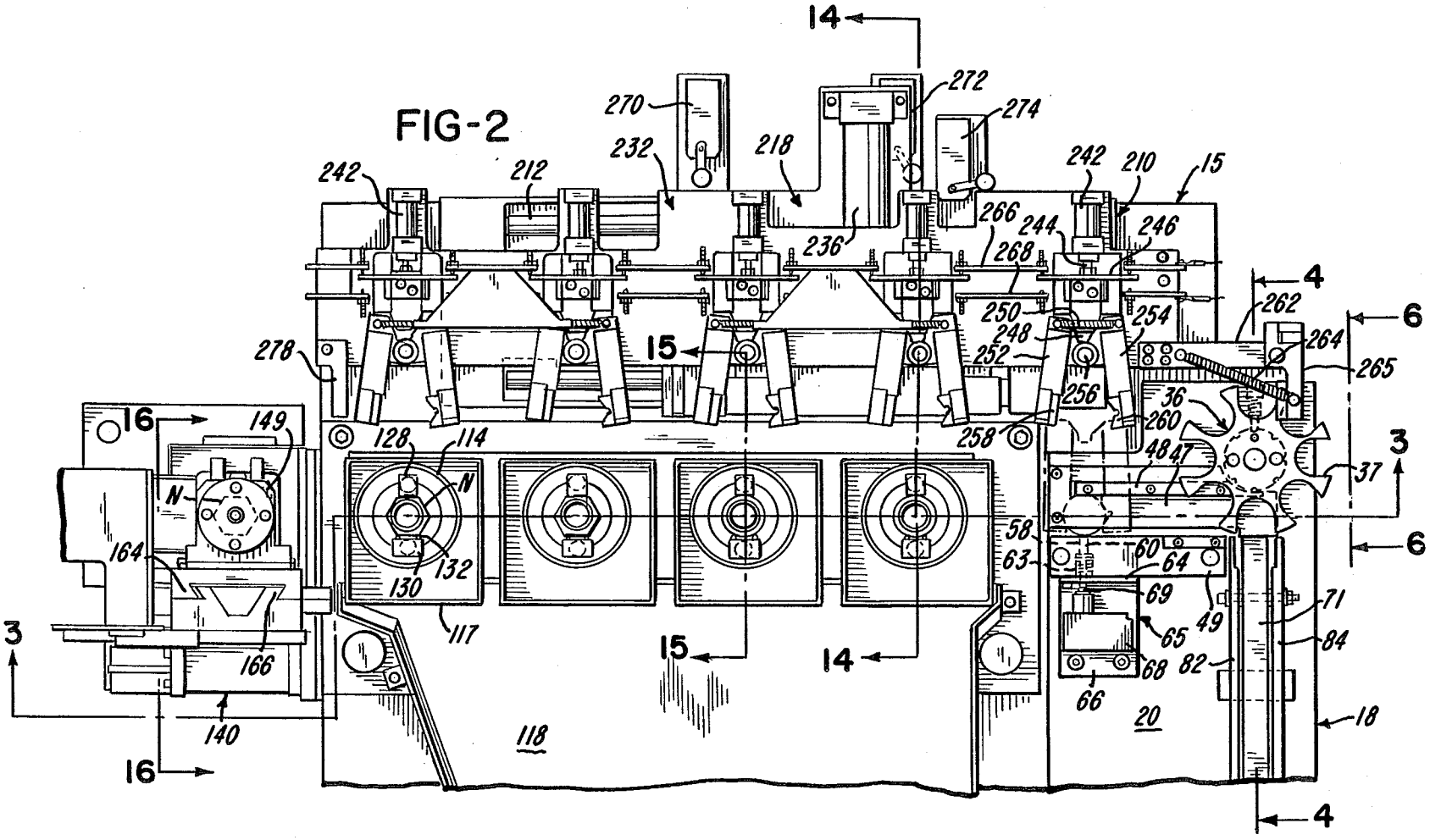
FIG. 2 is a plan view of that apparatus which is embodied in connection with the bed of the press.
Figure 3:
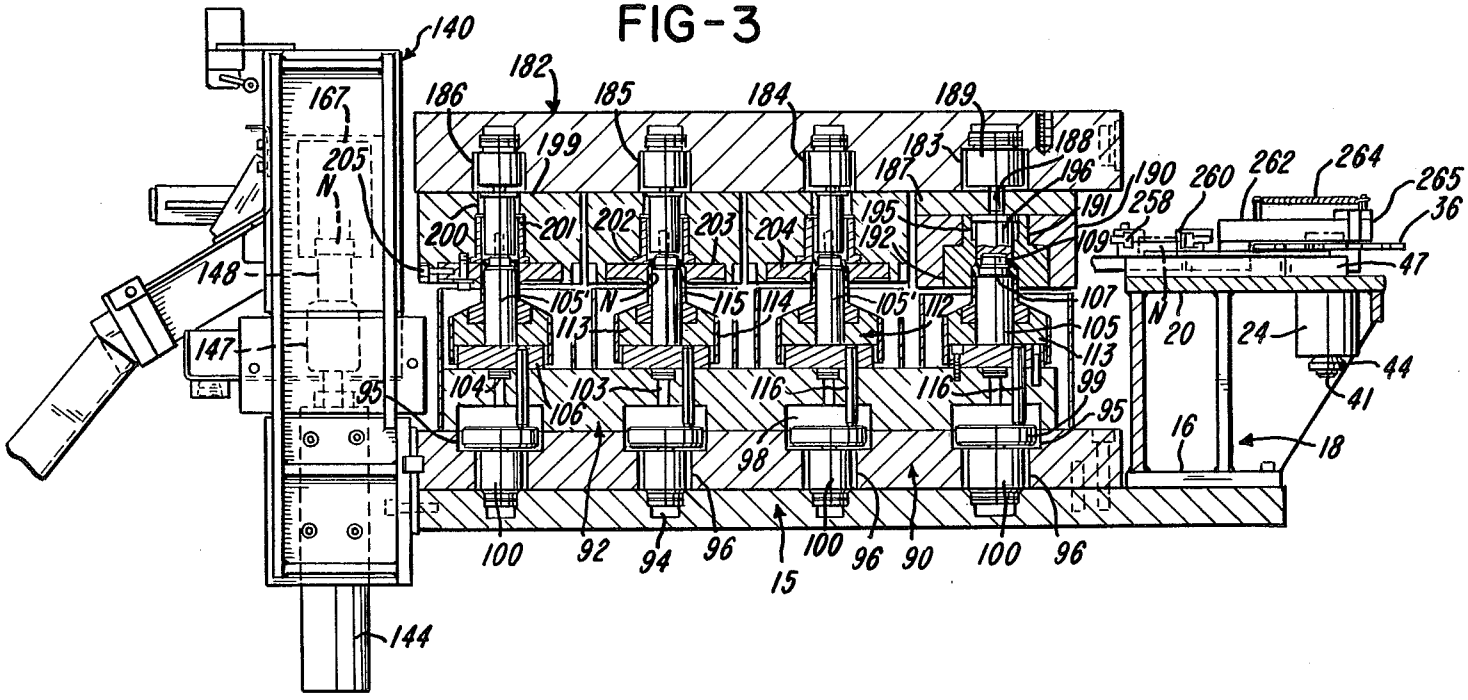
FIG. 3 is a vertical section taken on line 3—3 of FIG. 2.

Referring to FIGS. 2–4 of the drawings, the apparatus of the invention includes a star wheel 36 which has a central aperture and its outer periphery cut to form therein a plurality of equidistantly and circumferentially spaced notches 37. The innermost or base edge portion of each notch is formed as an arc having a uniform radius while its sides have a parallel spaced relation. As will be seen, the notches define receiving pockets for the material to be worked, which pockets are spaced by intervening radially directed spokes. A tubular element fixed in end abutted relation to one face of the star wheel 36 provides therefor a coaxially extended hub 38. The inner wall surface of the hub 38 has a diameter corresponding to that of the central aperture of the star wheel and forms therewith a passage provided with a counterbore 39 at the end thereof remote from the star wheel. The star wheel and its interconnected hub are mounted about and fixed to one end portion of a shaft 41 by means of a set screw 42.

The shaft 41 has an increase in its diameter for a very short portion of its length immediately of the end portion thereof which is lodged in the wheel-hub assembly 36, 38. This increase in diameter produces thereon a radial, circumferential projection one end face of which provides an annular shoulder 45 which seats in abutted relation to the annular base of the counterbore 39. The opposite end face 43 of the projection is conically convergent and bears on the inner race of the bearing unit 30 as the remainder of the length of the shaft depends therethrough and through and in a concentric spaced relation to the inner wall of the tubular element 24. The shaft 41 is reduced in diameter from a point spaced immediately below the counterbore 26 to a point spaced immediately above the counterbore 25. The counterbore 25 nests a second bearing unit 30 the outer race of which is held to the base thereof by a nut 44 threadedly engaged about the lower end of the shaft 41. A sleeve is positioned about the shaft 41 and clamped between and coaxially of the inner race portions of the bearing units. The construction and arrangement so provided positions the star wheel above and in a parallel relatively closely spaced relation to the plate 20. Fixed on the plate 20 immediately under the star wheel and to the rear thereof is a block from which projects the tip of a spring biased plunger 46 (FIGS. 4 and 4A). The latter is biased radially inward of the hub 38 to lodge, at any time when the star wheel is in a position of rest, in one of a plurality of dimples formed in and spaced equidistantly and circumferentially of the hub. In each such position of rest one of the pockets defined by a notch 37 has the opening therefrom in direct alignment with and its base directly facing the discharge end of a chute 50 which delivers thereto a tube element to be worked.

A plate 47 fixed to the upper surface of the plate 20 extends substantially from side to side thereof in a generally parallel relation to its front edge and in a line which positions its extreme right hand portion in an underlying closely spaced relation to the wheel 36 and immediately forward of its hub 38. A cutout in the right rear corner of the otherwise rectangular plate 47 provides for that portion of the back edge of the plate to curve around and across the front of the hub 38. In any case the plate 47 is narrow in width from its front to rear and its upper surface is co-planar with and has the right hand end thereof forming an extension of the discharge end of the base surface or floor of the chute 50. Superposed on and connected to the upper surface of the plate 47, between and parallel to its front and rear edges, is a guide bar 48 which is very shallow in depth. The front edge of the guide bar 48 is in a plane which is perpendicular to the plate 47 and intersects the apex of the base of each pocket 37 of wheel 36 which at any given time is placed in a position to receive a tube element from the chute 50 See FIG. 2 in this respect.

Positioned immediately forward of the front edge of the plate 47 and correspondingly the front edge of the bar 48 is the adjacent face of a rectangular bar 49 (FIGS. 2, 3, 7 and 7A) the base of which seats to the upper surface of the plate 20, the upper level of which rises above the level of the bar 48 and the length of which extends from adjacent the left hand limit of the plate 20 to a point immediately of the left hand side of the discharge end of the chute 50. The bar 49 is provided with parallel vertically oriented slots which extend from front to rear within the limits thereof, at locations spaced longitudinally of the bar, and serve to accommodate the projection therethrough of bolts the heads of which abut the uppermost surface of the bar and the opposite extremities of which serve to releasably secure the bar to the plate 20 in a position so its rearmost face is parallel to the forwardmost face or edge of the bar 48 and defines therebetween a space the front to rear dimension of which corresponds to that of the outer diameter of the tube elements to be worked in the press. As will be obvious, the slots in the bar 49 facilitate an adjustment in the position of the bar to change the spacing between the bars 48 and 49 within the limits of the slots, as and when necessary to accommodate a change in diameter of the tube elements to be worked.

The bar 49 is provided with a bore 58 (FIG. 7A) which extends therethrough perpendicular to its front and rear faces, in an adjacent, spaced, parallel relation to its left hand end and with its longitudinal axis at a level immediately above and in parallel relation to the plane of the upper surface of the plate 47. The bore 58 has a counterbore 59 at the end thereof which opens from the front face of the bar 49. Positioned within and projected from the bore 58, at each of its opposite ends, is a control rod 60. A very short portion of the length of the rod 60 within the counterbore 59, immediately of its base, is radially expanded, to produce thereon an annular projection one end face of which normally abuts the base of the counterbore and an opposite end face of which is abutted by one end of a coil spring 63. The latter is in a concentric spaced relation to and about that portion of the rod 60 within the counterbore and its opposite end seats to one leg 64 of a right angled bracket 65 which overlies the counterbore and is secured to the front face of the bar 49. The leg 64 includes therein an aperture in alignment with and accommodating the projection therethrough and bearing relation thereto of the portion of the rod 60 which projects forwardly of and perpendicular to the front face of the bar 49. The other leg 66 of the bracket 65 also projects forwardly of and perpendicular to the front face of the bar 49 and parallel to the upper surface of the plate 20. A switch 68 secured to the leg 66 includes an operator element 69 which is coaxial with the rod 60 and normally projected outwardly of the switch to position immediately of the forwardly projected extremity of the rod. The function of the rod 60 will be further described.

The chute 50 (FIGS. 1, 2, 4, 4A, 5 and 7) is channel-shaped in cross section and secured so the longitudinal extent thereof is connected to the plate 20 to position over its upper surface and in an adjacent, closely spaced, parallel relation to its right hand side edge.

The chute comprises a longitudinally extending base portion 70 formed from bar stock the upper surface 71 of which provides the floor of the chute which at its rearmost portion, is extended by a portion of the upper surface of the plate 47 which immediately underlies that portion of the wheel 36 which is directed aligned with the discharge end of the chute. Forward of that surface portion of the plate 47 providing an extension thereof which underlies the wheel 36, the floor 71, for a short distance (FIG. 4), has an upwardly directed slope which, in profile, is initially and briefly defined by a shallow curve and then by a line which extends tangentially of and upwardly from this curve at an angle to a horizontal which is approximately 35°.

The base 70 is supported over and in spaced relation to the upper surface of the plate 20 by two longitudinally spaced, relatively aligned, brackets 74 and 75. As seen in front elevation, the brackets 74 and 75 have a generally rectangular U shape the base portion of which is secured to the plate 20 and the vertically projected transversely spaced arms 76 of which receive therebetween a portion of the base 70 including its undersurface. The upper extremities of the arms 76, in the case of each bracket, provide laterally aligned apertures which align in turn with a bore extending transversely through that portion of the base 70 which is therebetween. These aligned apertures and the bore therebetween commonly have the body of a bolt 77 projected therethrough to provide that the head thereof abuts the outermost surface of one of the arms 76 and the opposite end thereof projects beyond the outermost surface of the other of the arms 76 of the bracket to receive thereon a washer and to be threadedly engaged by a nut 78. By such means and the application thereof the base 70 is secured in fixed relation to the upper ends of the brackets 74 and 75. As will be seen from the drawings, the bracket 74 which is positioned immediately of the front edge of the plate 20 has a vertical height which is greater than that of the bracket 75, which is spaced rearwardly thereof (FIG. 4) and parallel thereto. The arrangement is such to provide for the required vertical inclination of the floor surface 71 of the chute 50. Note that immediately of and rearwardly from the bracket 75 the undersurface of the base 70 is cut back so as to provide that it extends in a closely spaced substantially parallel relation to the upper surface of the plate 20. Furthermore, the longitudinal axes of the bolts 77, by virtue of the position of the bores in the base 70 through which they project, are not only parallel and in a longitudinally spaced relation but they lie in a common plane which is parallel to that portion of the undersurface of the base 70 which is forward of the bracket 75.

The framing of the chute 50 is completed by two lengths of angle iron which are L-shaped in cross section. In their application to form the chute the lengths of angle iron are dimensioned and arranged so they are coextensive with the base 70 and have their longest leg portions 82 position vertically and in a parallel laterally spaced relation which disposes them outwardly of and at their lowermost portions in an overlapped relation to the respective sides of the body 70. At the same time their shortest leg portions 84 are arranged, at least in part, to project over and in vertically spaced relation to the surface 71 of the base 70 and to project toward each other in a coplanar relation and have the longitudinal extent of their adjacent edges terminate in a spaced parallel relation.

Each of the overlapped dependent portions of the legs 82 has four apertures therein which are longitudinally spaced and in a line parallel to and in a closely spaced relation to its dependent edge (FIG. 4). The apertures in the dependent portions of the legs 82, as thus provided, are arranged as longitudinally spaced pairs and in each pair thereof they are transversely aligned with each other and with a bore formed in and transversely of the body of the base 70, at a location adjacent but spaced below the surface 71. Each pair of these transversely aligned apertures and the bore therebetween receive therethrough a bolt 86 the head of which abuts the outer surface of one of the legs 82, the body of which mounts washers which serve as spacers between each leg 82 and the adjacent side of the base 70 and the projected extremity of which outwardly of the other leg 82 mounts a washer and a nut 89. On tightening the nuts 89 on each of the respective bolts to which they apply, the leg elements 82 will be appropriately fixed outwardly of the sides of the base 70 to project vertically and upwardly of its surface 71 in a spaced parallel relation. The spacing between the leg elements 82 will be complementary to and in correspondence with the outer diameter of the tube elements to be directed through the chute 50. This spacing can obviously be readily adjusted by adding or subtracting the washer type spacers between the legs and the adjacent sides of the chute base 70. The mounting of the legs 82 as described position the shorter leg portions 84 above and in vertically spaced overlying relation to portions of the surface 71 in accordance with the spacing of the legs 82. The spacing between the surface 71 and leg elements 84 will be complementary to and in correspondence with the axial length of the tube elements. As will be obvious, the apertures in the legs 82 may be elongate slots arranged to enable a vertical adjustment of the legs 82 as and when required by the axial length of the tube elements to be worked.

In accordance with the invention, cap nuts will be derived from stock tubing, the inner diameter of which corresponds to that required for at least a portion of the length of the inner surface of the end product. The tubing is first cut into very short equal sections of its length, each of which is to constitute a tube element N to be formed into a nut. Such tube elements may be rapidly and effectively achieved using a tube cutter of the type designed and fabricated by Vulcan Tool Company of Dayton, Ohio. Following this step they may be delivered and introduced to the elevated entrance end of the chute 50, in successive following relation, utilizing a vibrating table and its discharge funnel. In their delivery the tube elements will have an attitude providing that one end bears on the surface 71 to position the longitudinal axis thereof perpendicular thereto. As so oriented, the tube elements slide down the chute with diametrically opposite portions of the outer surface thereof in substantially bearing relation to its sides and diametrically opposite portions of the upper end thereof adjacent and confined by the overlying legs 84.

The tube elements stack in and are precisely delivered by and from the chute, one at a time, to a receiving station defined by a directly facing pocket 37 of the star wheel 36. This places a tube element N at one end of its intended line of travel across the press, during the course of which it will be simply and quickly converted to the desired end product.

As will be seen, once a tube element to be worked arrives at its receiving station, it is moved laterally, from right to left, by means of transfer apparatus, and in a manner to be further described, to an idle or transfer station and following that to and from a series of five equidistantly spaced working stations comprising, in successive relation, a basic forming station, three shaving stations and a tapping station. The movement thereof is in essentially a straight line, horizontal, path and during such movement the tube element will be maintained with its length in essentially the same vertical attitude.

As seen in FIG. 3, two plates 90 and 92 are stacked, one over the other, on and secured to the plate 15. The lowermost plate 90 extends laterally across the plate 15 from its left side edge to a point immediately of the left side of the chute 50. The upper plate 92, which is somewhat shorter in its lateral extent and narrower from front to rear, is centered on the plate 90.

The plate 15 has a series of four cylindrically configured recesses 94 formed inwardly of its upper surface, to the left of the superstructure 18. The recesses 94 are respectively disposed below and in vertical alignment with one of the first four working stations above described so as to be coaxial with a tube element as it is positioned therein for a working thereof. Each of the recesses 94 has a counterbore providing a modest expansion of its diameter at its upper and outermost end. The plate 90 has a corresponding series of four apertures 96, each respectively in coaxial alignment with and forming an upward vertical extension of one of the recesses 94. The diameter of each aperture 96 is larger than that of the counterbored portion of the recess 94 which it vertically extends and this diameter is increased by a counterbore 95 at its uppermost end. Each recess 94 is vertically extended further by a coaxial cavity 98 formed in the undersurface of plate 92. The diameter and depth of this cavity corresponds to that of a counterbore 95 immediately thereunder. Thus, the peripheral side wall of cavity 98 forms a direct vertical extension of the corresponding side wall of the counterbore 95 and together therewith a surface bounding a vertically extending cylindrical chamber. Mounted within each of the four chambers so provided, for vertical reciprocation therein and in bearing relation to the side wall thereof, is the shallow cylindrical operating head 99 of a Nitrodyne cylinder 100 which mounts to the projected extremity of its piston rod 102. The cylinder 100 is in each case seated in the underlying coaxial recess 94 and vertical extension thereof provided by an aperture 96, its shape being complementary thereto. Note that "Nitrodyne" is the commercial designation and trademark of Teledyne-Hyson for its nitrogen gas pressured cylinder systems.

The inner and uppermost limit of each cavity 98 has an opening in its center defined by the lower end of a bore 103 which extends vertically and upwardly therefrom, coaxial therewith and in a line perpendicular to the upper surface of the plate 92 from which it opens, at which point the bore is expanded by a counterbore 104.

Each recess 94, and the vertical extensions thereof, has positioned thereabove and in coaxial alignment therewith a generally cylindrical rod-like forming die 105 including a radially expanded disc-shaped base 106 a central projection from the undersurface of which is plug fit in the counterbore 104 (FIG. 4). The latter is for the positioning of the die as its base seats on and is anchored by bolts to the upper surface of the plate 92. All four of the dies utilized in the basic forming and three subsequent working stations have the same base and those in the shaving stations are in fact otherwise identical in configuration. However, the generally rod-like extent of the basic forming die is slightly different as to its shape, as follows.

From its base and extending upwardly thereof, in the case illustrated, approximately 80% of the vertical extent of the basic forming die located at the first working station has a generally cylindrical configuration and uniform diameter. Immediately upward thereof the diameter of the die element is slightly reduced by the formation thereon of an extremely narrow radially and inwardly directed shoulder 107 which in vertical profile exhibits a slight conical configuration which is upwardly convergent and has an extremely short axial extent. The reduction in diameter effected by the shoulder 107 at its upper limit is continued throughout a relatively short following section 108 of the length of the rod-shaped portion of the die element which rises from its base. Immediately of the upper end of the section 108 there is a further reduction in diameter of the die 105, again provided by a narrow annular shoulder 109 being formed on the outer periphery of the die the contour of which in vertical profile exhibits a conical and upwardly convergent configuration the radial and axial extent is somewhat greater than that of the shoulder 107. The reduction of the diameter of the die as produced by the shoulder 109 is uniformly maintained throughout the remaining section 110 of the die to its upper projected extremity (FIG. 3).

The dies (designated as 105') located in the shaving stations of the press 10 differ from the basic forming die in that for a distance upwardly from their base 106 to a point the vertical extent of which is equal to that between the base 106 of the basic forming die and the shoulder 109 the diameter thereof is uniform and this diameter corresponds in dimension to that of the section 108 of the basic forming die. The reason for this in the demonstrated application of the invention apparatus to the forming of cap nuts will soon become obvious. The upper end configuration of the dies 105' used in connection with the shaving station shave a dimension and configuration corresponding to the upper end of the die 105, including the shoulder 109 and the upper end portion 110.

Each die 105, 105' mounts a shedder device 112 (FIGS. 3, 14, 14A and 15) which comprises an annular base 113 disposing about and in bearing relation to the lower uniform diameter portion of the vertical extent of its rod-like shape. The shedder base 113 is encircled by and its outer peripheral surface bears on a vertically oriented tubular wall structure 114 which depends about the die base 106 and to the upper surface of the plate 92. The wall structure 114 serves as a guide as the shedder moves vertically of the related die during the opening and closing of the press 10. The shedder base 113 has a counterbore of its central aperture at the upper end thereof producing therein a recessed annular shoulder and a cylindrical bounding wall surface to which is press fit the expanded base end of a thin walled shedder sleeve 115 (FIG. 14A) which projects upwardly from and coaxially of the base 113 and at the same time fits immediately about and in bearing relation to the lower uniform diameter portion of the rod-like shape of the related die element 105, 105'. As will be seen, the upper projected extremity of the shedder sleeve 115 is thereby adapted to align with the lowermost end of the tube element which is positioned in the working station to which it relates. The purpose and manner of function of the shedder device will be further described. Attention is directed to the fact that the shape of the upper surface of the composite of the shedder base 113 and the base of the shedder sleeve 115 which is integrated therewith has a generally conical configuration which adds strength and stability to the structure and insures an effective and positive function of the sleeve 115 as and when required.

The expanded base 106 of each die 105, 105' has four vertical bores therein which are respectively and directly aligned with mating bores in the plate 92. Projected through each pair of vertically aligned mating bores is a dowel 116 (FIG. 3) based at its lower end on the operating head of the Nitrodyne cylinder thereunder and at its upper end on the undersurface of the shedder base 113. The dowels 116 are at essentially diametrically aligned positions and serve as the medium through which the cylinder 100 may normally maintain a bias on the shedder device to induce its movement upwardly of the related die when the press is in an open condition or in the process of opening and means by which the reverse movement of the shedder device may be accommodated, cushioned and balanced, in obvious fashion, during the closing of the press.

Figure 14:
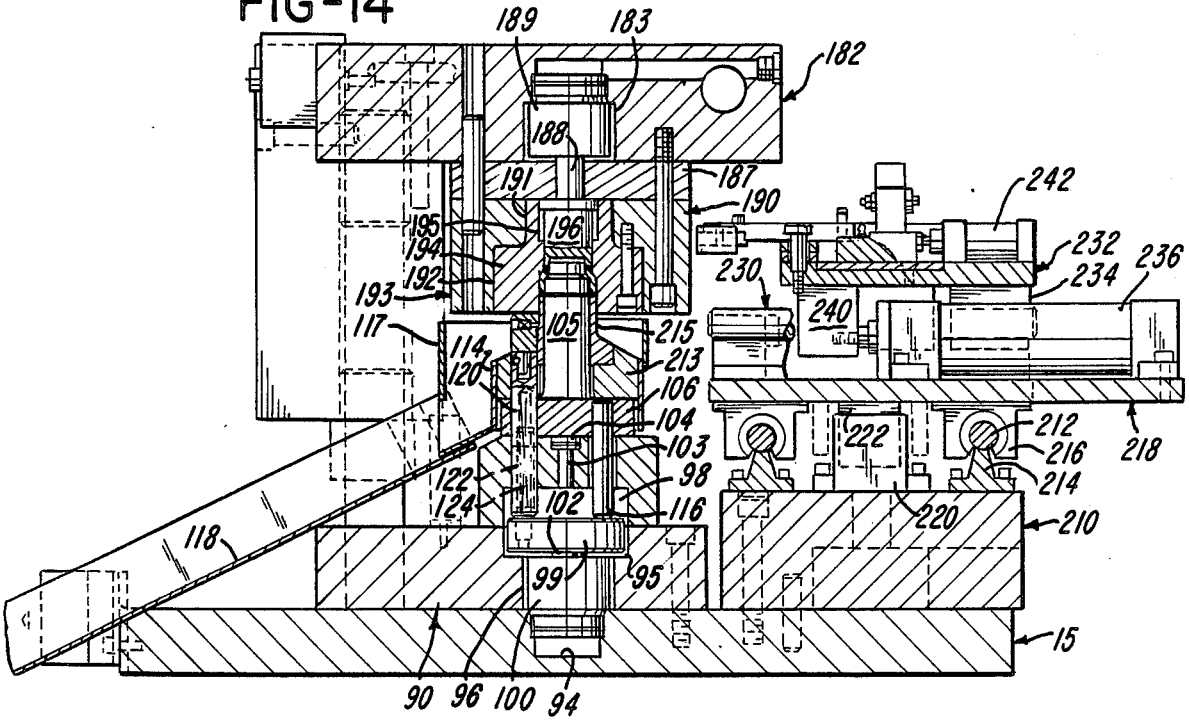
FIG. 14 is a sectional view taken on line 14—14 of FIG. 2.

As seen in FIGS. 2 and 14 a peripheral portion of each of the tubular wall structures 114 is welded to the back wall of a rectangular frame 117 peripherally of and outwardly from the die which it surrounds. Each such frame has an opening to the front and at the bottom thereof to a dependent vertically inclined tray 118 forming a chute serving to carry particles and/or fluid away from the area of the tooling employed and the tube elements to which such tooling is applied.

In addition to their other bores, the base 106 of each of the die elements 105, 105' and the base 113 of the shedder device 112 superposed thereon each have a pair of vertical bores at diametrically opposite positions. The arrangement of these bores, as between these elements, provides pairs of vertically aligned bores which are diametrically opposite, respectively to the front and to the rear of the die and the tube element N which positions in the working station to which they relate. Each said pair of vertically aligned bores is coaxially aligned with a further bore in the plate 92 and each series of vertical bores so provided is displaced from the positions of the dowels 116, substantially 45° from the adjacent thereof, and has therein and projected therethrough a cylindrical rod 120. Each rod see FIGS. 14 and 15, for example. 120 has a blind bore 122 which opens from its lower end and extends upwardly of its interior for a substantial portion of its length. The bore 122 accommodates therein a substantial portion of the length of a coil spring 124, the lowermost end of which seats to the base of an aligned cylindrical recess formed inwardly of and opening from the top of the underlying shallow cylindrical operating head 99 of a cylinder 100.

At each working station one of the two rods 120 has the length thereof vertically extended by a narrow rectangular block which is suitably anchored to its upper end to form thereon a head 128. One end portion of the head 128 projects outwardly from and radially of the rod 120 to which it is fixed and presents to the diametrically opposite rod 120, at its projected extremity, a flat planar surface. A somewhat wider rectangular block providing a head 130 is similarly secured to form an identical vertical extension of said diametrically opposite rod 120 and to have a portion thereof project radially therefrom in the direction of the head 128. The projected extremity of the head 130 is directly aligned with and in an opposing parallel relation to the surface of the projected extremity of the head 128. The head 130 embodies therein a pair of laterally spaced plungers 132 the tips of which are biased outwardly from the planar surface of its projected extremity in parallel lines which if extended would be perpendicular to the opposed planar surface of the projected extremity of the head 128. As will be seen, the plungers 132 and the opposed surface which they face will serve to receive therebetween and precisely establish, by a three point contact therewith, each tube element which is delivered to the working station which they define. When the press is in an open condition, a tube element N so positioned in any one of the first four working stations will be in vertical alignment with and in a vertically spaced relation to a die element 105, 105' immediately therebelow and tooling in connection with the ram directly thereabove. At this particular time only a predetermined lowermost portion of the vertical extent of a tube element will be between the heads 128 and 130 by which it is frictionally held in its given station. This facilitates and contributes to the efficiency and the effectiveness of the transfer mechanism, to be described, which controls the movement of the work material.

As will be more fully described, when the press is closed, the tube element N and the rods 120 embodying the heads 128 and 130 between which the tube element is held in the open condition of the press are driven downward, the rod elements 120 to a greater extent than the tube N. In each instance the tube element will be driven down, over and about the upper end of the underlying vertically aligned die and at the same time the greater vertical displacement of the rods 120 will be accommodated by the springs 124 in the course of this procedure.

Each rod 120 has a recessed flat 133 formed in and extended longitudinally of its outer peripheral surface adjacent its lowermost end. The respective ends of the flat 133 are defined by perpendicularly projected shoulder surfaces which are parallel. The upper surface of the plate 92 has a pair of radial recesses, each opening to a bore accommodating the projection therethrough of one of the rods 120. Each such recess accommodates a rectangular key 134 one end portion of which projects inwardly of the bore to which it relates to a location adjacent the flat 133 of the rod therein and between the shoulders which define its vertical extent. As will be obvious, the respective shoulders serve to define limits to the course of movement of the rods 120. This arrangement is such to insure that in the open condition of the press in which they are embodied the uppermost portions of all the heads 128 and 130 of the rods 120 are at essentially the same level and in a laterally spaced, relatively aligned, relation. This enables a virtually straight line movement of the tube elements N from one to the other of their working stations.

The fifth working station is established by apparatus connected at the left side of the press. This apparatus includes a generally rectangular composite plate structure 140 the lowermost portion of one side of which is anchored to the left end portions of the plates 15 and 90 so that it projects laterally of the press. The structure 140 extends upwardly from and perpendicular to the plates 15 and 90, approximately to the level of the ram 14 in the open condition of the press. A plate element fixed to project from the rearwardly facing surface of the plate structure 140 defines a horizontal platform 142 having a central aperture 143. The platform 142 is spaced above, adjacent and parallel to the plane defined by the upper surface of the plate 92. Positioned below the platform 142 and coaxial with the aperture 143 is a hydraulic motor 144. The latter is supported by a bracket structure bolted to and projected from the lowermost portion of the rear face of the plate structure 140. A lead screw 146 projected upwardly of, coaxial with and driven by the motor 144 mounts a chuck 147 which projects through the aperture 143 in a concentric spaced relation to its bounding wall surface. A tapping tool 148 is held by the chuck 147 to project upwardly therefrom and coaxial therewith. Fixed to the upper surface of the platform 142 is a rectangular block 149. The block 149 has a central bore 151 provided with a relatively deep counterbore 152 opening from its lowermost end which accommodates the projection therein of the tapping tool 148 and the upper end portion of the chuck 147. In the open condition of the press the uppermost portion of the tool 148 is in that portion of the bore 151 immediately upward of its counterbore 152.

The block 149 (FIGS. 2, 16) is provided with an additional pair of vertical bores 153 arranged at diametrically opposite positions with reference to and immediately outward of the bore 151, from which they are equidistantly spaced. Each of the bores 153 has an identical counterbore 154 of substantial depth which opens from the upper surface of the block 149 and a similarly directed second counterbore 155. Each counterbore 155 accommodates therein a cylindrical rod 120' the character and formation as well as the disposition of which is similar to that described with reference to the rods 120. As in the case of the rods 120, the rods 120' each have a blind bore 122' (corresponding to the bore 122) which opens from its lower end and extends upwardly of its interior for a substantial portion of its length. Each bore 122' accommodates a substantial portion of the length of a coil spring 124' the nature of which corresponds to that of the spring 124. As each rod 120' is inserted in a bore 153, namely that portion thereof defined by its counterbore 155, the spring 124' partially housed therein will have its then lowermost end portion projected outwardly from the lower end of the rod to position within and to have its projected extremity seat to the annular shoulder defining the inner limit of the counterbore 154.

Each rod 120' (FIG. 16) has in connection with that end thereof which is uppermost as it is applied in the block 149 a narrow rectangular head one end portion of which projects radially therefrom in the direction of the center of the bore 151. The heads of the respective rods 120' are respectively designated 156 and 157 in the accompanying drawings. Head 157 differs from the head 156 in that it houses a spring biased plunger 158 the tip of which projects from the center of its radially innermost face which is directly opposite and essentially parallel to the radially innermost face of the head 156 from which it is diametrically spaced.

As will be seen, in the open condition of the press the rods 120' will be biased upwardly of the block 149 by the springs 124' to establish heads 156 and 157 in precisely that position required to receive and hold therebetween a tube element N in preparation for a tapping operation. As so positioned the tube element to be worked will be in a direct alignment with and in a close vertically spaced relation to the tapping tool 148.

The upper surface of the block 149 has a pair of radial recesses 160 which are diametrically spaced with reference to the bore 151 and radially outward of the counterbored portions 155 of the bores 153 to which they respectively relate and open at their inner radial limit. A rectangular key 161 is fixed in each recess 160 to have its radially innermost end portion project radially inward of the counterbore 155 to which the recess opens to position its projected end surface immediately of and parallel to a flat 162 formed in and longitudinally of a portion of the length of that portion of the rod 120' accommodated in the counterbore. Note that the flat 162 is located on a portion of the outer peripheral surface of the rod 120' which is diametrically opposite, in each case, to that from which projects its interconnected head. As will be seen with reference to the drawings, the longitudinal extent of the flats 162 on the respective rods differ by reason of a stepped condition of the upper surface of the block 149 which places the keys 161 at different levels. In any case, the flat in the outer peripheral surface of each rod 120' is of substantial length and extends through its head at its upper limit. In the formation of each flat there is produced at its lowermost or innermost limit a shoulder 163 which in the assembled condition of the rod positions at a level below that of the portion of the key 161 which projects inwardly of the counterbore in which the rod is accommodated. The net result is that the portions of the keys 161 which respectively project in the counterbores 155 serve to provide limiting abutment surfaces which are contacted by the shoulders 163 under the influence of the springs 124' applied to the rods 120' in the open condition of the press to cause the heads of the rods, namely 156 and 157, to position precisely as required to receive and grip therebetween the lower end portion of the vertical extent of a tube element N on its delivery from the preceding work station, thus placing it in a position for the succeeding tapping operation.

Figure 16:
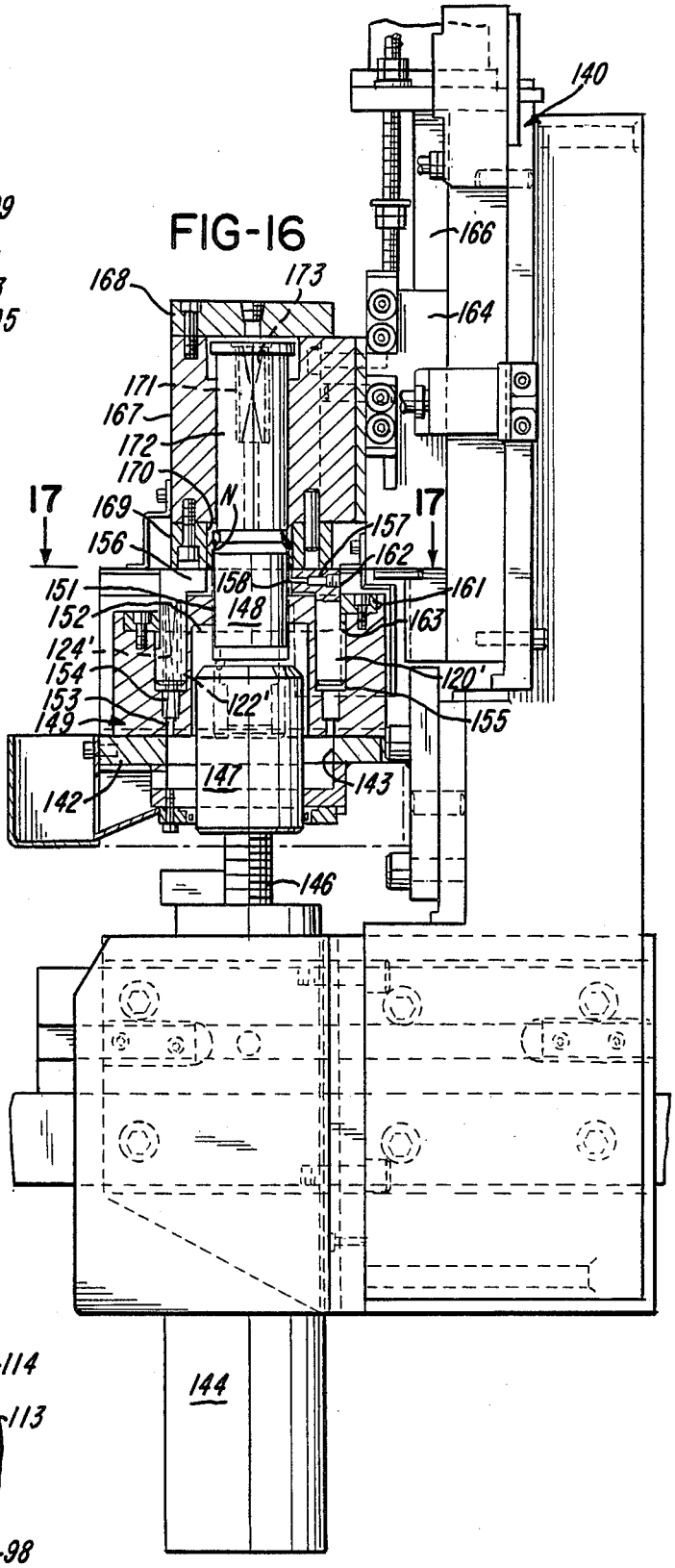
FIG. 16 is a sectional view taken on line 16—16 of FIG. 1.

An elongate, generally rectangular, block shaped structure 164 has a dovetailed relatively slidable engagement with a guide 166 fixed in connection with and extending vertically of an uppermost portion of the rear face of the plate structure 140 (FIGS. 2 and 16). A tubular body 167 having a fixed relation to the rearmost face of the block 164 is established thereby above and in a normally vertically spaced coaxial relation to the tapping tool 148. The upper end of the body 167 has a cap 168 and its lower end is extended by an abutted holding tool 169. The tool 169 is a plate formed with a central opening 170 which is located to be coaxial with the tubular body 167 and to have a bounding wall surface which is complementary in shape to that of the hex-shaped outer peripheral surface portion of the tube element to be worked in the form in which it has been received from the immediately preceding work station. The tool 169 is appropriately set to the position required by application thereto of dowels in a conventional manner prior to it being fixed to the body 167 by bolts. The uppermost end of the bore of the tubular body 167, immediately under its cap 168, has a relatively shallow counterbore 171 accommodating the relatively expanded head end of a tubular knockout element 172. The element 172 depends through and bears on the inner wall surface of the remainder of the bore of the body 167 to have the lower end portion thereof depend from the lower end of the body 167, to the extent permitted by the depth of the counterbore 171, within and in a concentric spaced relation to the bounding wall surface of the opening 170 (FIG. 16). The element 172 also has a counterbore at its uppermost end, forming a shoulder inwardly thereof seating one end of a coil spring 173 the opposite end of which projects from the knockout element to abut and be backed by the inner surface of the cap 168. As will be obvious on observing the drawings, in the open condition of the press the lowermost end of the element 172 will position within the vertical limits of the opening in the tool 169. Particular attention is directed to the fact that the outer diameter of the lowermost portion of the knockout element in this case has a diameter which is greater than the inner diameter of the uppermost end of the tube element N as received and positioned in coaxial alignment therewith by the heads 156 and 157 of the rods 120' therebelow in the open condition of the press. This dictates that in the course of the tapping operation the lowermost end surface of the knockout element 172, at the outer peripheral portion thereof, will serve as an abutment surface for the upper end of the tube element N as it is subjected to a tapping operation by the tool 148. This will be further described. As will be further obvious, coincident with the closing of the press and the closing of the tools 148 and 169 on a tube N in the tapping station, the tool 169 will engage and depress the rods 120' and their interconnected heads to displace the heads 156 and 157 from the axial length of the tube element. This will cause springs 124' to be compressed and store energy. As the tapping operation is completed and the holding tool 169 is displaced relatively upward of the tube element which has been worked, the springs 124' will then function to restore the position of the heads 156 and 157 to that which they had on receiving this particular tube element in the tapping station, preliminary to the tapping thereof. The tube element, now a finished product, will be ready for ejection from the tapping station in a manner to be further described.

As will be obvious from the drawings, suitable means are provided for a vertical adjustment of the slide 164 and together therewith the assembly including the tubular body 167 and tool 169 as and at the time or times required, depending on the nature of the product to be worked.

The interrelation and function of the tooling just described will be further detailed in connection with a description of the cyclic function of the total apparatus of the invention as embodied in the press.

Also included in connection with the platform 142, at its undersurface, is suitable structure, illustrated in the drawings, providing for a stabilizing of the chuck as it is moved vertically upward from the motor 144 to carry the tapping tool 148 upwardly to achieve its tapping function.

Further associated with and in connection with the platform form 142 and the plate structure 140 is a tray structure the purpose of which is similar to that of the tray associated with and serving to carry particles and/or fluid away from the tooling and the tube elements being worked thereby in the preceding work stations. Also included is an associated chute-like structure through which the finished work products may be discharged in automatic fashion as they are kicked out of the tapping station by the transfer mechanism of the invention.

A back up plate 182 (FIGS. 1 and 3) is fixed to and centered with reference to the undersurface of the ram 14. The undersurface of the plate 182 has four cylindrical recesses, respectively designated 183, 184, 185 and 186, from right to left, as seen in FIG. 3 of the drawings. Each of these recesses is in a coaxially aligned relation to and has a shape and counterbore corresponding to those of one of the recesses 94 in the plate 15.

Figure 14A:
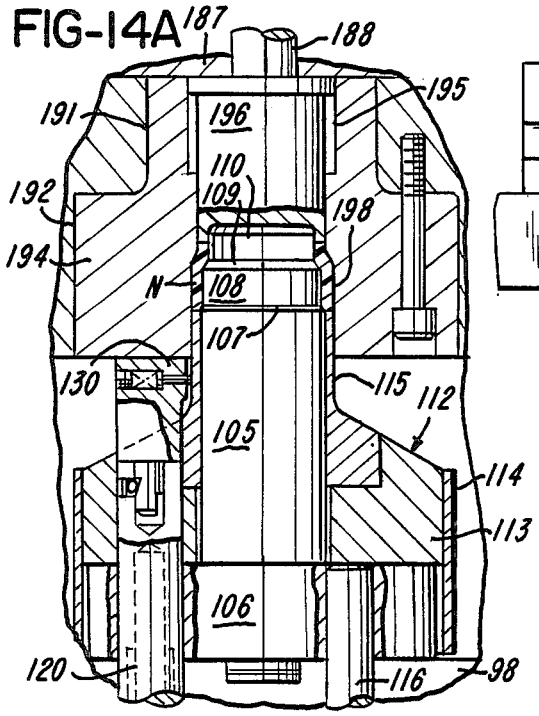
FIG. 14A is an enlargement of a portion of FIG. 14.

The recess 183 and that recess 94 with which it is vertically aligned are aligned in turn and coaxial with each tube element N delivered to the first working station of the press, in this instance, the basic forming station. An individual backup plate 187 fixed in underlying abutted relation to the undersurface of the plate 182 caps the lower opening from the recess 183 and contains therein a Nitrodyne cylinder 189 the nature and character of which is similar to that of the cylinder 100. The plate 187 has a small central aperture coaxial with the recess 183 which accommodates the projection therein and bearing relation thereto of the cylinder piston rod 188. A rectangular block 190 having a central vertical bore 191 expanded at its lower end by a counterbore 192 is fixed to form a direct dependent extension of the plate 187 and provide therewith a tool holder 193. The bore and counterbore of the block 190 as capped by the plate 187 nests a press fit forming tool 194 which is complementarily shaped at its outer periphery (FIG. 14A). The tool 194 has a central vertical bore 195 counterbored at its upper end to produce therein an annular shoulder surface facing and parallel to the adjacent surface of the plate 187. Within the counterbored upper end of the bore 195 is the expanded head end of a cylindrical element 196 limited in its movement in the course of its function by the shoulder surface and the plate 187. The element 196 normally has a downward bias, applied thereto by way of the piston rod 188 of the Nitrodyne cylinder 189. Below its expanded head portion, the body of the element 196 depends in bearing relation to the wall bounding the bore 195 between its upper counterbore and a specially formed counterbore 198 of its lowermost end. The latter counterbore is complementary in shape to that of the stepped upper end of the die 105 of the basic forming station, which in the open condition of the press is below and coaxial therewith.

As should be obvious (FIG. 14A), as the press is closed subsequent to a tube element N being delivered to and between the head 128 and 130 of the rods 120 at the basic forming station, an annular projection of the outer peripheral portion of the lower end surface of the cylindrical element 196 engages the upper end of the tube element and drives it down, over and about the upper end of the forming die 105. At the same time, the tool 194 depresses the heads 128 and 130 against the bias of the springs 124. Since the position of die 105 is fixed, as the tool 194 and the element 196 therein move downwardly with the ram, the pressure applied to the tube element by way of the element 196 is transmitted through the tube element to the shedder sleeve 115. This, in turn, drives down the shedder 112 and the dowels 116 until the latter bottom the operating head 99 of the cylinder 100, thereby to store energy in the cylinder. As the press is completely closed and the tool 194 is driven down over the tube element in its path, the latter is accommodated in and shaped to the configuration dictated by the formed upper end of the die 105 and the complementarily shaped wall bounding the counterbore 198. The element N is consequently pressured by the shear and compression forces developed in its containment to be formed into the stepped cylindrical tubular element, dictated by the applied tool and die. Note that the inner diameter of the element N at the lower portion of its vertical extent is not changed from that which it had when it was originally delivered to the basic forming station. When the press opens, the energy previously stored in the Nitrodyne cylinder 189 is transmitted therefrom through the shedder sleeve 15 to kick the tube element N upwardly to the position and orientation which it occupied on its receipt in the basic forming station. At this point the lower end of the vertical extent of the basically formed tubular element N will be located at and held between the heads 128 and 130 as previously described, the latter having been similarly kicked back to their original positions by energy stored in the springs 124 during the closing of the press.

In the embodient illustrated, the three stations which successively follow the basic forming station are shaving stations. Within these three stations a limited portion of the vertical extent of the outer peripheral surface of the tube element N is successively shaved to produce thereon the hex shape required. Note that there is little difference in the tooling provided in connection with the ram at the respective shaving stations. In this respect attention is directed in particular to FIGS. 3 and 15 of the drawings. It may be seen from FIG. 3 that each of the recesses 184, 185 and 186 has a shape similar to but slightly smaller in size than that of the recess 183. Abutted to and fixed in underlying relation to the plate 182 are three separate rectangular block shaped parts 199, respectively having an identical bore 200 and respectively capping, in part, the opening from the counterbore at the lower end of one of the recesses 184, 185 and 186, in each of which is contained a Nitrodyne cylinder 189'. Each cylinder 189' is of a nature and has a function similar to that of the cylinder 189.

In each instance the bore 200 is central to the block 199, coaxially aligned with the recess which it partially caps, and successively counterbored from its lower end to form three vertically spaced shoulders in the bounding wall thereof. The first and uppermost of these shoulders is narrow and seats thereto the outer peripheral portion of the upper end surface of a bearing sleeve 201. The latter is press fit in the bore 200 to have an external flange 202 at its lower end seat to a second slightly wider shoulder provided by the second of the counterbores. The third counterbore 203 is quite shallow, cylindrical in configuration and substantially larger in diameter than the previous counterbore. The counterbore 203, in each case, nests therein a series of narrow elongate, generally rectangular, radially oriented, circularly spaced, cutting or shaving tools 204. The radially innermost ends of the tools 204 are positioned to precisely outline the hex cut configuration to be produced on the outer periphery of the tube element to be worked in the station to which they apply.

Figures 7, 9A, 9B, 9C, 9D, 9E, 10:
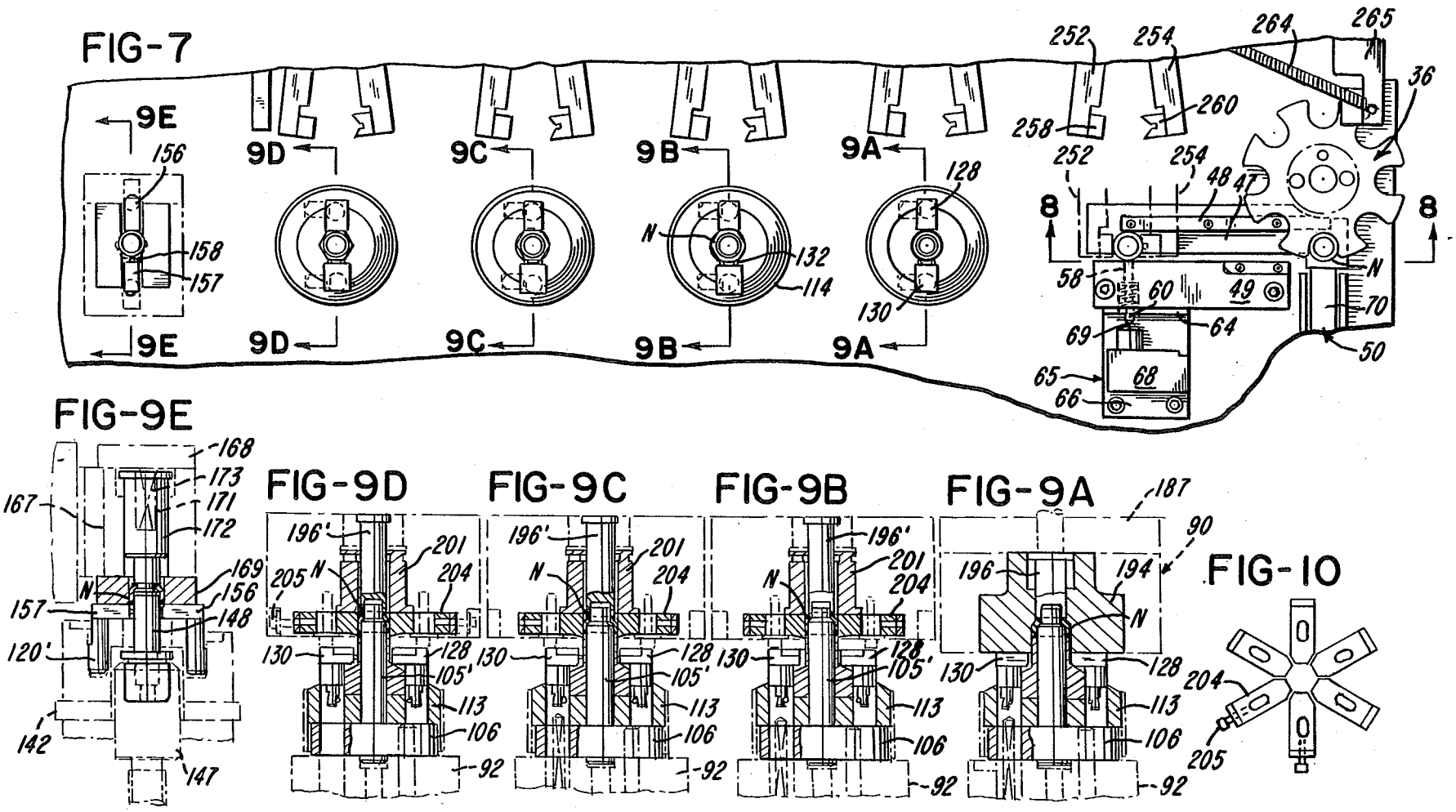
FIG. 7 is a fragmentary enlarged view of a portion of the showing in FIG. 2 to emphasize details thereof, parts being eliminated for clarity of disclosure.
FIGS. 9A, 9B, 9C, 9D and 9E are sectional views respectively taken on lines 9A—9A; 9B—9B; 9C—9C; 9D—9D; 9E—9E of FIG. 8.
FIG. 10 is a diagrammatic layout of the cutting tools embodied in connection with the ram of the press, vertical detail of which tools are shown in FIG. 8.
Figure 15:
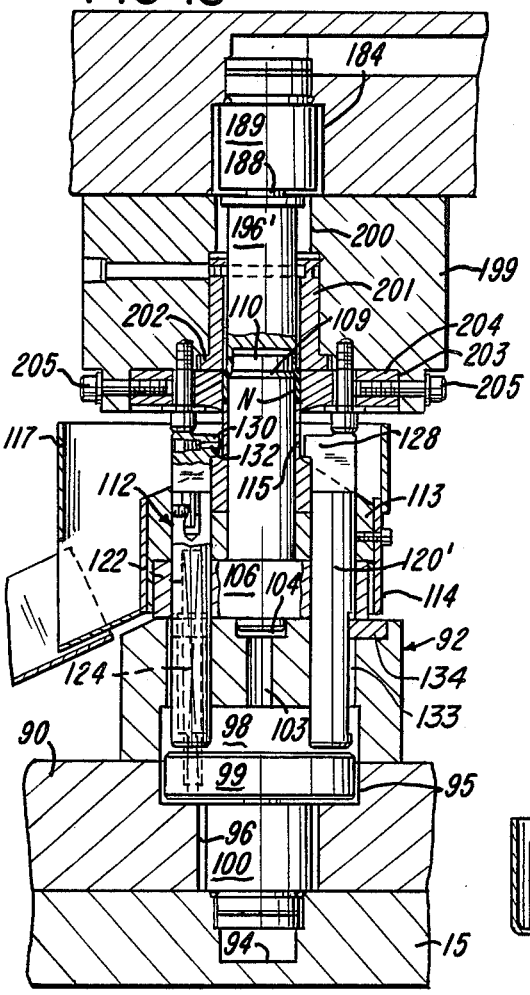
FIG. 15 is a sectional view taken on line 15—15 of FIG. 1.

Observing FIGS. 10 and 15, each tool 204 has a short longitudinally directed slot therein intermediate its ends accommodating the application therethrough of the body of a screw which serves to clamp and fix the tool to its backing surface, in an obvious manner. Radial adjustment of a tool 204 within the limits permitted by the longitudinal extent of the slot in the body thereof, prior to its being set in place, is achieved by means of a screw 205 applied to threadedly engage in its radially outermost end, through an intervening portion of the block 199 which serves as the wall bounding the counterbore in which it seats. The radial adjustment of each is a simple and precisely controllable procedure.

Note that the only essential difference between the tools 204 in the respective working stations to which they apply will be in their positioning to achieve the cut or shave they are required to make and/or the nature, dimension and form of their cutting edges.

In the block 199 of each of the three shaving stations, the bore 200 and that of the sleeve 201 accommodates a cylindrical part 196', the expanded head end portion of which positions in the bore 200 above and in overlapping relation to the upper end of the sleeve while the body thereof depends through and in substantially bearing relation to the extension of the bore 200 defined by the inner wall surface of the sleeve. In the open condition of the press the part 196' will be biased downwardly of the sleeve 201, by pressure applied thereto through the piston rod 188' of the cylinder 189' to have its lowermost end portion normally position within and in concentric relatively closely spaced relation to the boundary defined by the innermost limits of the tools 204. The outer peripheral portion of the lower end surface of the element 196' is relatively extended to define thereon an annular coaxial projection which, as seen, for example, in FIG. 15, is in direct alignment with the upper end of the tube element N below and aligned coaxially therewith in the working station to which the related tools apply.

The function of the shaving tools in each of the three shaving stations should be obvious from the foregoing. It will nevertheless be further detailed in a following description of the cyclic function of the total of the invention apparatus herein illustrated.

Referring to FIGS. 2, 11, 13 and 14, the transfer mechanism utilized in the practice of the invention in the embodiment herein illustrated includes three elongate rectangular plates stacked in parallel, vertically spaced relation to each other on the plate 15, immediately to the rear of and parallel to the plate 90. The length of the lower two plates is in a direction perpendicular to the left and right sides of the press 10. The lower of these plates provides a platform 210 anchored on and extending along the rearmost portion of the upper surface of the plate 15 in a location centered between its lateral extremities and the outer sides of the press. The front face of the platform 210 is perpendicular to upper surface of the plate 15 and is immediately to the rear of and parallel to the rearmost face of the plate 90. A pair of rails 212 secured to and coextensive with underlying supports 214 define a track which is anchored to and extends across the upper surface of the platform 210 from a point adjacent and spaced from its right extremity, as the press is viewed in front elevation, to a point adjacent and spaced from its left extremity. More specifically (FIG. 14), one of the rails 212 is located adjacent, spaced from and parallel to both the plane of the front face of the platform 210 as well as its upper surface. The other of the rails 212 is located adjacent, spaced from and parallel to the plane of the rear face as well as that of the upper surface of platform 210. The rails 212 are thus themselves in a parallel spaced relation and they commonly position in the same horizontal plane.

Mounted on and spaced longitudinally of each rail 212, in a partially encompassing, bearing, sliding relation thereto, are two pillow blocks 216. The four pillow blocks 216, so mounted, are interconnected with and dependent from the under surface of a second plate defining a platform 218 which bridges the rails 212 and correspondingly the track of which they form a part. The arrangement of the pillow blocks 216 establishes them in a rectangular pattern in which they provide longitudinally spaced pairs, the pillow blocks of each such pair being in an identical transversely spaced relatively aligned relation. As so mounted the platform 218 is not only established in a horizontal plane but conditioned for reciprocation longitudinally of the rails 212 under the control of a hydraulic cylinder 220.

The cylinder 220 is anchored to the upper surface of the platform 210 between, parallel to and equidistant from the rails 212 with one end thereof adjacent and spaced from the right hand edge of the platform 210 and its opposite end positioned about midway the length of the rails. Its piston rod 221 projects through, from and in bearing relation to its head at said opposite end thereof to engage in and be releasably connected with a small rectangular block 222 (FIG. 14) which is fixed in connection with and dependent from the platform 218. The platform 218 is thus conditioned for its cyclic reciprocation in accordance with an appropriate application of hydraulic fluid to the piston of the cylinder 220. The cylinder 220 is a conventional unit the detail of which per se should be well understood by those versed in the art.

Figure 11:
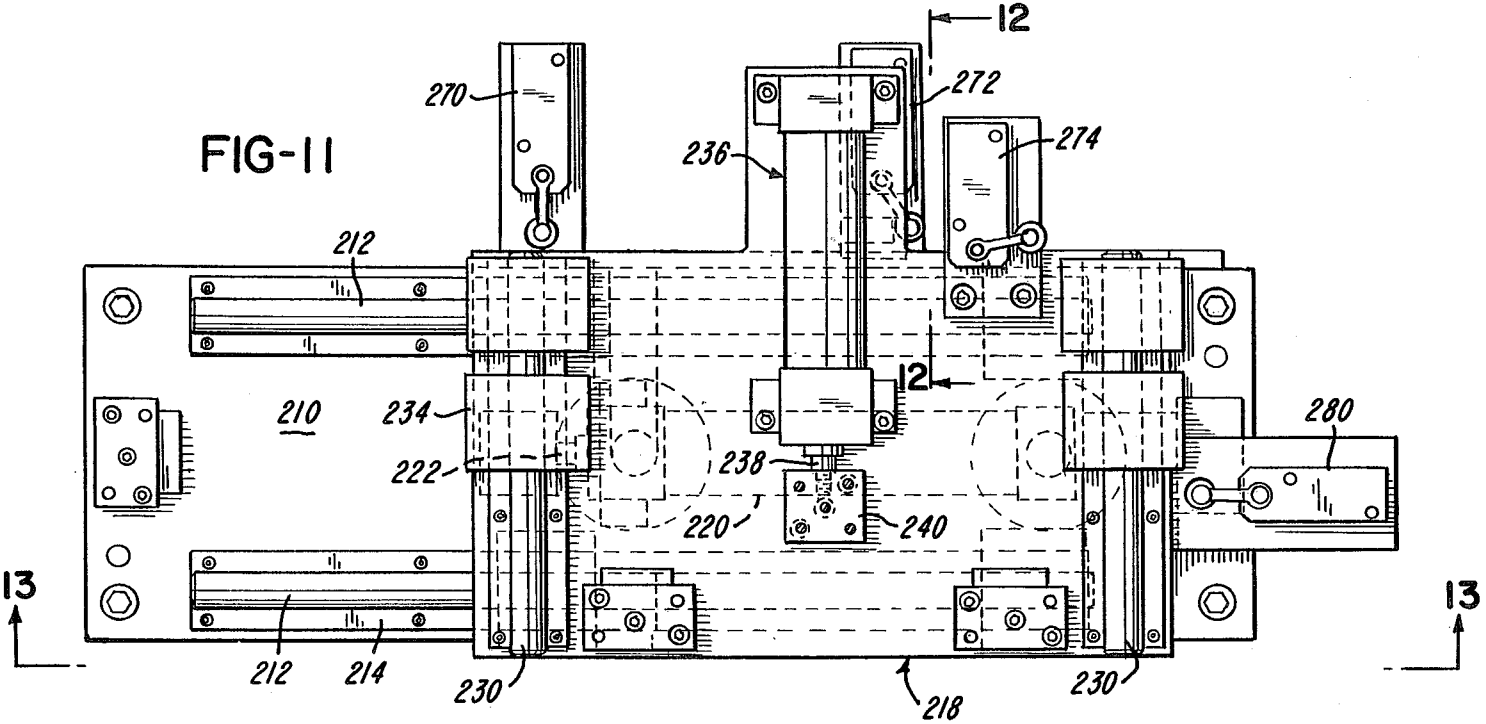
FIG. 11 is a plan view of the transfer mechanism embodied in the press with its upper plate and the structure mounted thereon being removed, the latter being shown in detail in FIG. 2.
Figure 7A:
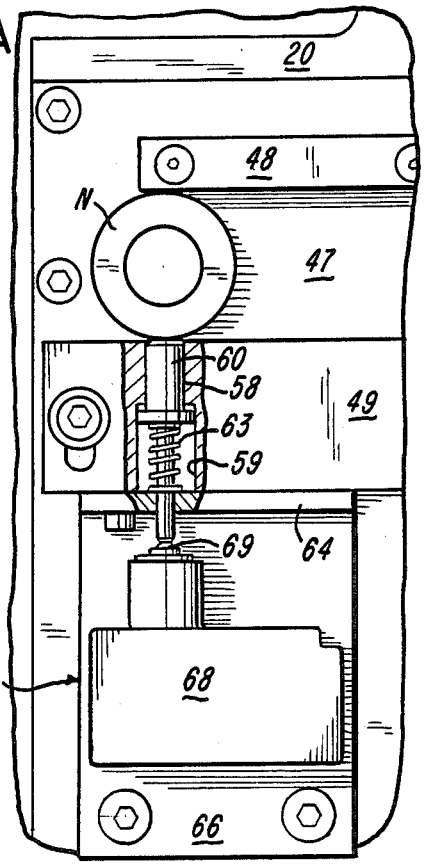
FIG. 7A is an enlargement of a portion of FIG. 7.
Figure 12:
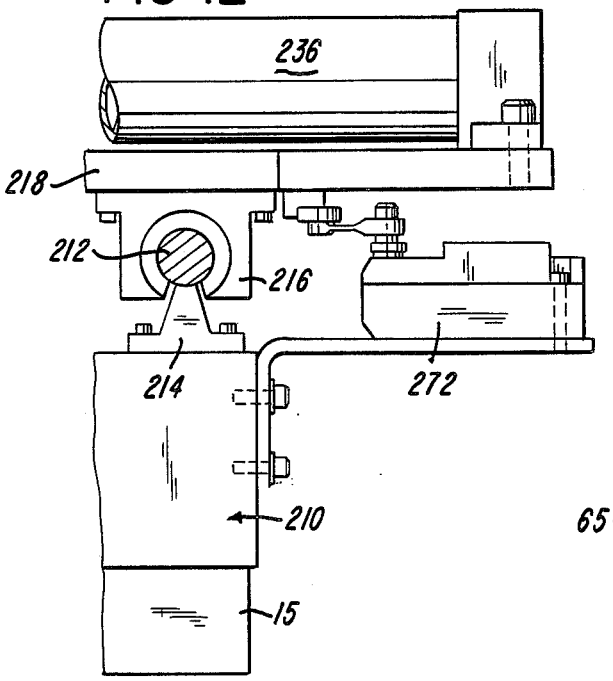
FIG. 12 is a sectional view taken on line 12—12 of FIG. 11.
Figure 17:
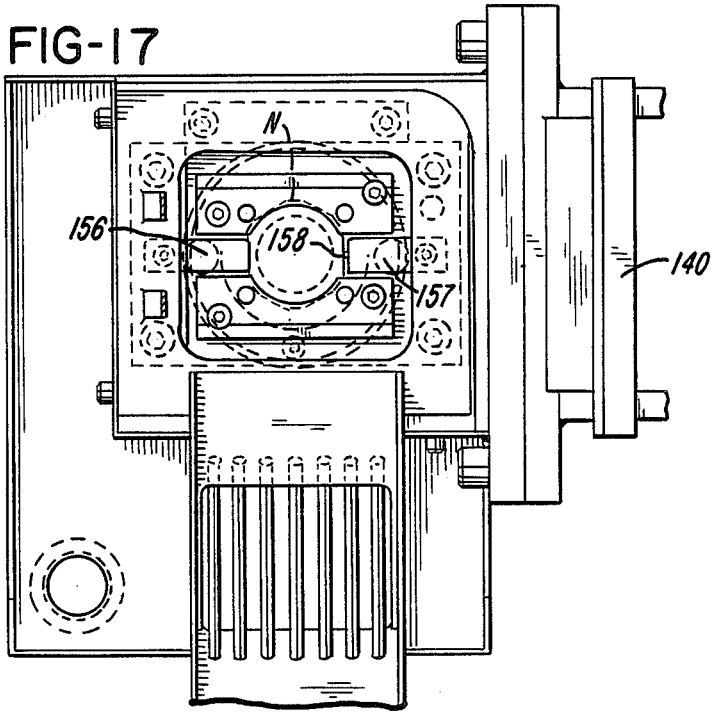
FIG. 17 is a sectional view taken on line 17—17 of FIG. 16.
Figure 13:
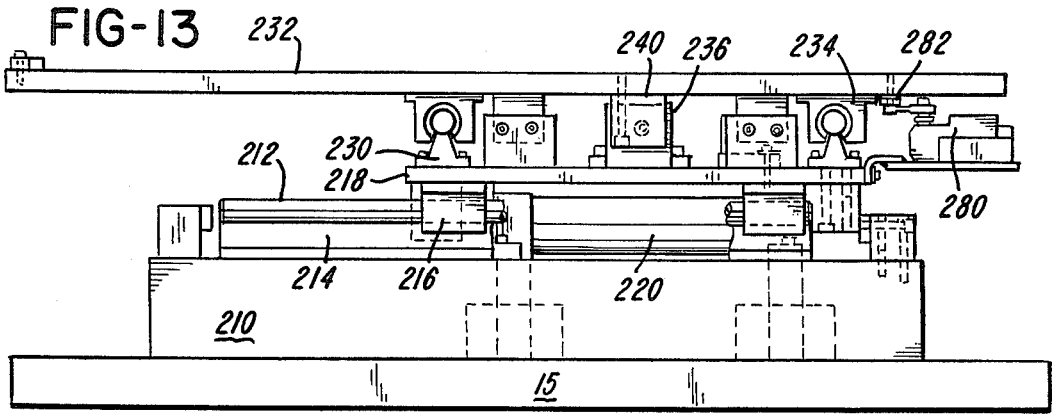
FIG. 13 is a front elevation view of the structure of FIG. 11, taken on line 13—13 thereof.

A pair of rail assemblies 230 (FIGS. 11 and 14), which correspond structurally to the assemblies comprised of the rails 212 and their supports 214, are mounted in connection with and in upstanding relation to the uppermost surface of the platform 218. In this case the rail assemblies and the track which they define are in a direction extending from front to rear of the press 10, and correspondingly at right angles to the direction of the longitudinal extent of the rails 212. Viewing the rail assemblies 230 in plan view, as seen in FIG. 11, one thereof is in an adjacent spaced parallel relation to what might be considered the left hand edge of the platform 218 and the other adjacent, spaced from and parallel to its right hand edge. Positioned above and in spaced elevated relation to the rail assemblies 230 is a third elongate rectangular plate, the length of which extends from right to left of the press 10, defining the third platform 232. Fixed to and dependent from the undersurface of the platform 232 are four pillow blocks 234 which have a sliding bearing relation and a relative disposition with respect to the rails of the assemblies 230 the nature of which is identical to that of the interrelation of the pillow blocks 216 with the rails 212. Mounted on and in connection with the upper surface of the platform 218, between, parallel to and spaced equidistantly from the rail assemblies 230, is a hydraulic cyinder 236. The rearmost head of cylinder 236 is anchored to the platform 218 at a location to the rear of the rearmost ends of the rail assemblies 230 and its forwardmost head is anchored to the platform 218 approximately in line with the midpoints of the lengths of the rail assemblies (FIG. 11). Projected through and in bearing relation to the forwardmost head of the cylinder 236 is its piston rod 238. The projected extremity of the rod 238 is engaged in and releasably connected with a small block 240 fixed to and dependent from the undersurface of the platform 232 (FIG. 13). By virtue of this connection the cylinder 236 is operatively related to the platform 232 for a reciprocating movement thereof over and in a plane parallel to that defined by the platform 218, in a direction toward the front and rear of the press 10 and at right angles to the direction in which the platform 218 may be reciprocated.

Prior to the commencement of its function, in the embodiment herein illustrated, the platform 232 is positioned directly below and to the rear of the idler and the first four working stations of the press which follow. Take particular note that, as originally received in such stations, the tube elements to be worked have a common level and vertical orientation. The platform 232 (FIG. 13) incorporates five rearwardly projected portions each of which mounts on the upper surface thereof a hydraulic cylinder 242. The cylinders 242 are in an equidistantly and laterally spaced parallel relation providing that their respective piston rods 244 project forwardly therefrom in parallel lines which if extended would respectively intersect a different one of the idler, basic forming and shaving stations heretofore described. In each case the line of intersection would extend through a lowermost portion of the vertical extent of the tube element N in the related station, along a diameter thereof the direction of which is at right angles to the line of such stations. The projected extremity of each piston rod 244 is connected to the center of one face of a transversely disposed metal plate 246 which is perpendicular thereto. A wedge shaped cam 248 is fixed to project from and perpendicular to the opposite face of the plate 246 and to project, in turn, between the rearmost ends of plate-like lateral extensions of adjacent facing side edges of a pair of side by side relatively closely spaced fingers 252 and 254. Such lateral extensions are located along a rearmost portion of the longitudinal extent of each finger and project rearwardly thereof. The forwardmost ends of these lateral extensions, which are short of the midpoints of the lengths of the respective fingers, include portions which are formed to overlap and receive therethrough a pin 256. The pin 256 is anchored to and projects upwardly from and perpendicular to the plate 232, adjacent its forwardmost edge. From a point immediately to the rear of the overlapped portions thereof the longitudinally and rearwardly directed adjacent side edge portions of the lateral extensions have a relatively divergent relation, thereby to define a laterally expandable notch the configuration of which adapts to the degree of projection therein of the head of the cam 248. The portions of the lateral extensions which project rearwardly of the respective fingers 252 and 254 are bridged by and respectively have anchored thereto the respective ends of a coil spring 250. The spring 250 applies a bias to cause the angularly related adjacent side edge portions of the lateral extensions of the fingers to be maintained in bearing relation to the forwardly convergent sides of the head 248 as it moves inwardly and outwardly thereof under the influence of the projection and retraction of the rod 244. As will be seen, during a retracted condition of the rod 244 the portions of the fingers which are forwardly of and beyond the location of the pin 256 have their widest angle of divergence.

The overlapped portions of the lateral extensions of the fingers 252 and 254 are provided with suitable underlying and overlying bearing surfaces and they are contained thereby against movement axially of the pin 256. The fingers 252 and 254 are thereby pivotally mounted on and conditioned for a consistently smooth pivoting movement with relation to the pin 256 as well as each other.

As seen in plan view in FIG. 2, the inner side of the left hand finger 252 has a planar surface portion at its outer end which is opposed to a V-shaped notch 260 provided as a facing inner surface portion at the outer end of the finger 254.

A narrow elongate generally rectangular bar 262 (FIGS. 2, 3, and 7) has one end portion thereof secured to the top of the forward right hand corner portion of the upper surface of the plate 232 and projects to form an extension thereof. An arm 265 is pivotally connected to the outermost end of the bar 262 to normally project forwardly therefrom and perpendicular thereto by virtue of a limiting interengagement of a part thereof with a part of the bar 262 under the influence of the bias of a spring 264, one end of which is anchored to the bar adjacent the end thereof connected to the plate 232 and the other end of which is anchored to the remote end of the arm 265. Said remote end of the arm 265 projects forwardly of the bar at a location to overlap a rear portion of the star wheel 36, in a slightly spaced elevated relation thereto, in a line which overlies the right hand limit of the hub 38. This is the relative position of the arm 265 at a time when the transfer mechanism is in position to start an operating cycle thereof.

Mounted in connection with the forward left hand corner of the upper surface of the plate 232 and projecting forwardly of, outwardly from and perpendicular to the line of the forewardmost edge of this plate is an arm 278 the function of which is to induce a discharge of a work product, in this case a cap nut, subsequent to the finishing thereof in the tapping station.

Attention is directed to the fact that the transversely disposed metal plate 236 interconnected with each piston rod 244 is designed to have its right and left hand end portions respectively move between and parallel to parallel metal plates 266 and 268 which define the limits of its reciprocating movement in correspondence with the projection and retraction of the piston rod to which it mounts. At the limits of its movement so defined, each metal plate makes contacts which are embodied in suitable circuitry which conventionally controls the operation of the related cylinder 242.

Reference is also made to FIGS. 2 and 11 of the drawings wherein are diagramatically illustrated the switch elements 270 and 272 which are respectively engaged by a suitable control portion dependent from the under surface of the platform 218 to thereby determine the limits of its movement along the rails 212. Likewise the location and nature of the switches 274 and 280 determine the limits of movement of the platform 232 in the course of its movement during the cyclic function of the transfer mechanism. These switches are likewise embodied in conventional circuitry to achieve the end result required in the utilization of the apparatus in the production of cap nuts in the manner and for the purpose herein illustrated and described.

A cyclic description of the above described apparatus, by way of example, and not by way of limitation is as follows:

In the production of cap nuts per the practice of the invention and utilizing the apparatus herein described and illustrated, welded steel tubing selected from stock the inner diameter of which corresponds to that of the thread to be formed in and along all or a portion of the length of its inner surface is first automatically and rapidly cut into short sections N thereof which are equal in length. The length of the sections will be determined by the required length of the finished product, considering the working thereof to be performed. The tube elements are then passed, by way of a vibrating table and a discharge funnel, one immediately following the other, to enter the upper end of the chute 50 in an attitude providing that one end thereof bears on the chute base surface 71 to position its relatively short longitudinal extent and correspondingly its longitudinal axis perpendicular thereto. This attitude of the tube elements is maintained as they slide through and downwardly of the chute 10, confined at their sides by the chute portions 82 and as to their vertical or axial extent between the chute portions 71 and 84. The elements N inherently move through and downwardly of the chute in a following abutting relation under the influence of gravity. The lead tube element N will move onto the plate 47 and into an aligned pocket 37 of the star wheel 36, maintaining all the while the same vertical attitude.

This movement of the lead tube element N into its receiving station and at the same time to the right end of the guide channel defined by the upper surface of plate 47 and the bounding guide bars 48 and 49 is smooth and precise. It does, moreover, establish the lead element N at one end of a substantially short straight line course of travel from one working station to another until it is finished as a cap nut.

Given an energization of the cylinder 236, with the plate 232 in the position shown and described with reference to FIG. 2, as will be the case at the time of a commencement of a cycle of operation of the work transfer mechanism, the plate 232 and its interconnected structure will be moved forward to the limit determined by the contact of a part thereof with the operator of the switch 280. As this occurs the arm 265 is brought to a position immediately to the right of the tube element N then held in the receiving station. The arm 265 is at a level spaced immediately above the star wheel 36 so that at this time, since only a short lowermost portion of the vertical extent of the tube element N is contained within the pocket 37 of this wheel, the major portion of its vertical extent is in its path. The contact made as between a part of the structure in connection with the plate 232 and the operator of the switch 280 triggers the control system of the transfer mechanism to instantaneously energize the cylinder 220 and cause its piston rod to project and move platform 218 the extent of one working station to the left. During this procedure the arm 265 cams the tube element N essentially the length of the guide channel 47, 48, 49 to precisely position it in the idler station at the left end thereof. At this point the tube element N cams the spring biased rod 60 outwardly of the channel, to be held thereby against an opposite portion of the bar 48. At the same time it also operates the switch 68 to signal its arrival at the idler station and to simultaneously close a circuit inducing the retraction of the piston rod of cylinder 236 and correspondingly the platform 232. The latter, through the medium of the contact of a part of plate 232 with the operator arm of switch 274, closes a circuit inducing the cylinder 220 to retract its piston rod 222 and move the plate 232 to the right, to the starting point of its cycle of operation.

As will be seen, the movement of the tube element N from the receiving station to the idler station by the arm 265 inherently indexes the star wheel to advance, clockwise, one notch, the plunger 46 functioning in obvious manner to enter the next succeeding dimple and set the next pocket 37 of this wheel directly opposite and to open to the discharge end of the chute 50. This next pocket then automatically receives therein the next in line of the tube elements N.

As soon as the plate 232 has returned to its starting position, as signalled by the limit switch 272, the cycle of the transfer mechanism is immediately repeated. This time, as in all instances, as the plate 232 moves forward it carries therewith the five sets of paired fingers 252, 254 the divergent forward extremities of which project substantially and equidistantly beyond the forward edge of the plate 232. At the forward limit of their travel, the tips of the fingers of each pair position respectively upstream and downstream of and equidistant from the working station to which they relate at the start of their cycle as part of the transfer mechanism.

More specifically, as the plate 232 comes forward once more and the arm 265 positions immediately to the right of the tube element N just delivered to the receiving station, the tips 258, 260 of the paired fingers immediately to the left thereof position respectively to the left and right of that portion of the tube element N previously delivered to the idler station which rises above the level of the bar 48.

As soon as the forward positioning of the plate 232 has been sensed by the switch 280, not only does this switch produce the signal which terminates the projection of the rod 238 of the cylinder 236 but it is also responsible for the production of a signal which causes the actuation of suitable controls to project the piston rods 244 of the cylinders 242. Cams 248 come forward therewith, each thrusting inwardly of and between the rear end portions of fingers 252 and 254. This produces a closing of their tips 258, 260 on the tube element N, if any, at that station to which they relate. Coincident with the closing of the tips of the paired fingers as just described, the plates 246 in connection with the piston rods 244 simultaneously make appropriate contact at the limiting plates 268, thereby to close a circuit triggering a signal producing an operation of the cylinder 220, namely a projection of its rod 221. The platform 218 and its superstructure is resultingly displaced a distance to the left corresponding to one working station. As a consequence thereof, each pair of fingers are advanced one station to the left, carrying therewith the tube elements N, if any, which they have gripped. In the process of this the arm 265 advances a tube element N from the receiving to the idler station and by way of this tube element indexes the star wheel 36 to present the next pocket 37 thereof to the chute 50, whereupon it receives therein the next tube element N discharged from the chute under the influence of gravity.

The fingers 252 and 254 which have gripped the element N in the idler station carry the same therewith to the basic forming station, maintaining all the while the vertical orientation of its central axis. The direction of the fingers 252 and 254 in the course of their lateral movement maintains the direction of the movement of the element N in a straight line insuring that at the forming station the lower portion of the vertical extent of the tube element is introduced between the adjacent opposed surfaces of the heads 128 and 130 of the rods 120' at that station. The result is that the tube element N is gripped and held in a fashion to maintain its vertical orientation and establish it in a vertically spaced relatively aligned relation to the tooling in the forming station. Correspondingly, if any tube element had been present in any of the forming or shaving stations, they would likewise be advanced and positioned in the following station.

Simultaneously with the advance of the tube element N from one to the next following station and the establishment thereof at said following station, as occurs in all such instances, a signal thereof is transmitted to the switch 270 by way of engagement of a portion of the platform 218 with the switch operator arm. Coincident with this occurrence there is a signal to the press which initiates a closing of the ram on the press bed, in the process of which to displace the tube elements N in respective working stations downwardly over the upper ends of the coaxially related dies and effect a working thereof as dictated by the tooling applied in such stations. By virtue of the effect produced on the switch 270,the piston rods 244 of the cylinders 242 are retracted sufficiently to spread the outer tips of the fingers 252, 254 and at the same time the plate 232 is retracted under the influence of a retraction of the piston rod 238 of the cylinder 236. When the retraction of the plate 232 is indicated to the engagement of a part thereof with the operator arm of the switch 274, once again a circuit is closed inducing a control of the cylinder 220 to cause it to retract its piston rod 221 and move the plate 232 to the right, back to the starting point of the cycle of operation of the transfer mechanism.

Giving specific consideration to the forming station, as the press is closed, just as previously described, the tool and die elements and the structure associated therewith at the forming station function to achieve a modification of the worked material to form it into a stepped cylindrical tubular element. The details of the forming procedure have been heretofore described and do not appear to require repetition at this point in this disclosure. It is significant to note, however, that the lower portion of the vertical extent of the formed tubular element exhibits the originally provided configuration of the tube element and, at this point, the portion thereof which has its largest external diameter. Within the limits of the vertical extent of this lower portion is that part of the formed element which is to be successively shaved in the three following shaving stations to produce thereon the hex shape required to facilitate its application and manipulation.

As may be seen, once the operation of the press is started, the cycling of the transfer mechanism will continue uninterruptedly, in the process of which to advance each of the tubular elements delivered to the receiving station to each of the following stations in a straight line path, throughout which their vertical orientation is maintained. As will be seen, within the limits of each working station the working required is achieved by means of a direct coaxial movement of the applied tools. The cycling of the transfer mechanism to move the tube element as worked in the forming station from there to each of the succeeding shaving stations is precisely the same as described with reference to the movement of the tube element from the idler to the forming station. Accordingly, the details need not further described since they will be obvious to those versed in the art from the previous description. As the press is closed the cutting tools utilized in the first shaving station will axially apply to make an initial cut of the lower larger diameter external surface portion of the formed die element presented thereto to produce thereon a basic six sided shape. In the second shaving station the resultant worked product will be subjected to a similar but relatively deeper second cut and in the third shaving station the final cut will be made to shave the lower end portion of the vertical extent of the tube element being worked to the precise shape and dimension required of the end product.

It will be noted, as in the first instance, that there are five pairs of fingers 252, 254 in connection with and projected forwardly of the platform 232, the arrangement dictating that in the original position of the plate one pair of fingers will be directed toward each of the idler the, forming and the three succeeding shaving stations. In the course of the cyclic operation of the transfer mechanism, as the plate 232 and the fingers thereon are moved one station to the left, as and in a manner previously described, the pair of fingers at the far left will carry a tube element the shaving of which has been completed in the third shaving station into the tapping station heretofore described to move the lowermost portion of its vertical extent between the opposed heads 156 and 157 of the rods 120' therein, presenting thereto a pair of opposed flats. As thus positioned the shaved tube element N will be in coaxial alignment with both the tapping tool 148 and the element 172.

The construction of the tooling in the tapping station has been previously described in some detail. Accordingly, as should be clear, from the drawings, concurrently with the closing of the press, in timed relation to the cycling of the transfer mechanism, the body 167 and the tool 169 are lowered to provide that the tool 169 seats to the block 149 in rimming relation to the upper end of the bore 151, immediately of and peripheral to the tube element N. The arrangement provides that the tube element N is then contained, at its respective ends, between the block 149 and the element 172, the latter of which is under the influence of the bias of the spring 173. As will be obvious, the tube element N will be contained against rotation by the holding tool 169 as the tapping tool 148 moves upwardly and inwardly thereof to form the necessary thread. Suitable switch controls, not shown, are provided to limit the course and extent of vertical travel of the tapping tool to that required. The tapping tool will be conventionally induced to retract upon completion of its thread forming operation, at which time the body 167 together with the element 169 at its lower end will be caused to move upwardly to clear the tube N the working of which has been completed to provide that it is then in the form of a cap nut the production of which is the objective of this whole procedure. Consequently the rods 120' will rise under the influence of the springs 124' to once more grip and hold the lower end portion of the vertical extent of the tube element which is now in its finished form.

As the platform 218 and its superstructure moves one station to the left in the immediately succeeding cycle of the transfer mechanism, with the plate 232 in its forwardmost position, the arm 278 which immediately leads the pair of fingers 252, 254 at the extreme left of the plate 232 engages and discharges the finished nut from the tapping station to the chute structure associated with and to the left thereof. The immediately trailing fingers which grip and carry a tube element N from the third shaving station then set this element in the tapping station at the limit of their travel.

As will be self-evident, the structure and practice of the invention is such that within a given time period one can achieve an extremely high production of economically formed cap nuts. For a similar production of other annular or tubular fittings or sleeve-type connectors and fasteners having the character of nuts one need only modify the particular tooling in the work stations and/or the number of the stations in correspondence with the particular application required.

The invention in any case provides a method for fabricating annular or tubular fittings, sleeve-type connectors and fasteners, especially those having the character of nuts or like coupling devices, utilizing stock tubing, comprising the steps of delivering the tubing in short lengths thereof to a receiving station, maintaining the orientation of the tubing for the working thereof and working the tubing to the desired end product by applying tooling to the opposite ends thereof while maintaining the cross section of at least a portion of the length of its interior surface at essentially that of the interior surface of the stock tubing. Such is evidenced in the practice herein illustrated.

At the same time the invention provides apparatus for converting short lengths of tubing, constituting tubular elements, into nuts, fittings, sleeves or other tubular or annular fasteners or coupling devices distinguished by utilitarian exterior and/or interior surface portions comprising means defining a plurality of stations, in each of which each tubular element must be positioned in the course of its conversion, including a receiving station and a plurality of working stations, the means defining said receiving station being constructed and arranged to establish a predetermined orientation of the tube elements received thereby, mechanism for the transfer of the tube elements from said receiving station to each of the other said stations in series relation, and tooling in essentially coaxial alignment with each said tube element as the tube element is positioned in a working station and operable to apply endwise and/or, at least in part, along the length and axially thereof to work said tube element to produce a change in the configuration and/or dimension of at least a part thereof while maintaining its originally provided inner diameter along at least a portion of its length.

The features of the transfer mechanism and its application are similarly significant.

In any case the system and method of the invention greatly facilitates the production of high quality end products from relatively inexpensive tubular stock material in an extremely short period of time and the components thereof are so constructed and arranged as to be simplistic in character and function as to absolutely minimize maintenance requirements with respect thereto.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for converting short lengths of tubing, constituting tubular elements, into nuts, small fitting, sleeves or other tubular or annular fasteners or coupling devices distinguished by utilitarian exterior and/or interior surface portions comprising means defining a plurality of stations, in each of which each tubular elements must be positioned in the course of its conversion, including a receiving station and plurality of following stations at least a portion of which are working stations, means defining said receiving station presenting a horizontally disposed base surface and immediately thereabove, in a plane which is in an adjacent spaced relation thereto, means including laterally spaced elements arranged to closely confine therebetween and establish a mount of a tubular element delivered to said receiving station with one end thereof in abutment with and its longitudinal axis perpendicular to said base surface, said base surface at said receiving station being laterally extended in linear fashion in the direction of the following of said stations, means for the transfer of said tube elements from said receiving station to each of the other said stations in series relation, tooling in essentially coaxial alignment with and in a vertically spaced relation to each said tubular element as it is positioned in a working station, said tooling in each said working station being constructed and arranged to apply endwise and/or, at least in part, along the length and axially of the tubular element aligned therewith to produce a change in the configuration and/or dimension of at least a part thereof while maintaining the original inner dimension of its interior cross-section within at least a portion of its length, said means immediately above and spaced from said base surface of said receiving station including a rotatable wheel constructed and arranged to include a series of equidistantly spaced notches in its outer periphery, each of which notches is bounded by a pair of said laterally spaced elements to form in said wheel a pocket complementary to such of said tubular elements as are delivered to said receiving station, said transfer means including means movable therewith constructed and arranged to serve as the medium for inducing the movement of a tubular elements in said receiving station to the next following station in the process of which to index said wheel to present a succeeding pocket thereof over said base surface to define therewith said receiving station, means being provided to insure the movement of the tubular element from said pocket in said receiving station to said next following station with the length thereof in the same vertical orientation and based on the same level as that on which it was originally positioned in said receiving station.

2. Apparatus as in claim 1 wherein said base surface in said receiving station is extended laterally of said receiving station between means defining therewith a shallow channel, said channel extends to one of said stations constituting an idler station which is immediately subsequent to said receiving station and said transverse means comprises a portion thereof which, when said transfer means is energized, is operative to apply to the upper portion of tubular element then in the receiving station and slide it along said channel to said idler station, in the process of which and through the medium of the element moved thereby to rotate said wheel and position the next successive notch therein line with and to automatically receive therein the next tubular element delivered to said receiving station.

3. Apparatus for converting short lengths of tubing, constituting tubular elements, into nuts, small fittings, sleeves or other tubular or annular fasteners or coupling devices distinguished by utilitarian exterior and/or interior surface portions comprising means defining a plurality of stations, in each of which each tubular elements must be positioned in the course of its conversion, including a receiving station and a plurality of following stations at least a portion of which are working stations, said receiving station being defined by means including rotatable means contructed and arranged to successively receive and establish said tubular elements in a vertical orientation, transfer means for moving said elements from station to station while maintaining their vertical orientation, said transfer means including means for engaging a tubular element in said receiving station and moving it to the next following of said stations, control means the operation of which is triggered on arrival of a so engaged and moved tubular element in said next following of said stations to cycle said transfer means to carry said engaging means back to said receiving station to similarly engage and repeat its performance with reference to a further tubular element positioned in said receiving station, other engaging means mounted to said transfer means to move and cycle therewith, said other engaging means being operable to selectively engage and move tubular elements, if any, in said following stations to their next following station in the course of the operation of the first said engaging means to move a tubular element from said receiving station to its following station, and said control means comprising means constructed and arranged to maintain a course of movement of said transfer means and said engaging means therewith in lines which define a rectangular pattern and fall in a common generally horizontal plane.

4. Apparatus for converting short lengths of tubing, constituting tubular elements, into nuts, small fittings, sleeves or other tubing or annular fasteners or coupling devices distinguished by utilitarian exterior and/or interior surface portions comprising means defining a plurality of stations, in each of which each tubular element must be positioned in the course of its conversion, including a receiving station and a plurality of following stations at least a portion of which are working stations, said receiving station being defined by means for receiving and retaining said tubular elements in a vertical orientation, transfer means for moving said elements from station to station while maintaining their vertical orientation, said transfer means including means for engaging a tubular element and control means for moving said engaging means to and inducing the engagement thereof to a tubular element in one of said stations for the movement of said engaging means and said element engaged thereby to the next following station, the disengagement of said engaging means from said element on deposit of said element in the next following station and the withdrawal therefrom and the return of said engaging means to the point from which it originally moved to commence its cycle of operation, said control means being constructed and arranged to maintain a course of movement of said engaging means in lines which define a rectangular pattern and fall in a common generally horizontal plane, said receiving station being comprised in part of means defining a base surface fo each said tubular element delivered thereto and providing that one end of said element seats to said base surface and, as so seated, the length of said element rises upwardly therefrom and perpendicular thereto and is laterally stabilized by means forming a further part of said receiving station which is immediately over, adjacent to and in a plane spaced from said base surface part of said receiving station, said further part of said receiving station being defined by a pivotally mounted wheel having notches defining a series of circumferentially spaced pockets in its outer periphery, and means determining an indexed rotation of said wheel to successively present the pockets thereof, one at a time, over and in a vertically spaced alignment with said base surface part of said receiving station for the delivery thereto of one said tubular element.

5. Apparatus as in claim 4 wherein said transfer means includes means forming a part thereof positioned to function, in a cycle of operation thereof, to engage an upper portion of the length of the tubular elements in said receiving station which rises above said wheel to move said element from the receiving station to the next following of said stations in a straight line path and in the same vertical orientation as that in which it was positioned in said receiving station.

6. Apparatus as in claim 5 wherein said straight line path between said receiving and the next following station is defined, at least in part, by an extension of said base surface part of said receiving station which serves as a base for the verticallly oriented element as it is being moved from said receiving station to the next following station and said part of said transfer means engaging and moving said tubular element from said receiving station has a cycle of operation and pattern of movement in correspondence with that of the first mentioned element engaging means.

7. Apparatus for converting short lengths of tubing, constituting tubular elements, into nuts, small fittings, sleeves or other tubular or annular or coupling devices distinguished by utilitarian exterior and/or interior surface portions comprising means defining a pluraity of stations, in each of which each tubular element must be positioned in the course of its conversion, including a receiving station and a plurality of following stations at least a portion of which are working stations, said receiving station being defined by means for receiving and retaining said tubular elements in a vertical orientation, transfer means for moving said elements from station to station while maintaining their vertical orientation, said transfer means including means for engaging a tubular element and control means for moving said engaging means to and inducing the engagement thereof to a tubular element in one of said stations for the movement of said engaging means and said element engaged thereby to the next following station, the disengagement of said engaging means from said element on deposit of said element in the next following station and its withdrawal therefrom and the return of said engaging means to the point from which it originally moved to commence its cycle of operation, said control means being constructed and arranged to maintain a course of movement of said engaging means in lines which define a rectangular pattern and fall in a common generally horizontal plane, said transfer means comprising a plurality of said first mentioned element engaging, said plurality of said engaging means being laterally spaced in accordance with the spacing of said working stations and being so constructed and arranged as to simultaneously move and function in the same plane and rectangular pattern of movement which provides that each said element engaging means engages the tubular element to which it applies at a level intermediate the ends of its vertical extent at a location above and spaced from its lower or base extremity.

8. Apparatus for converting short lengths of tubing, constituting tubular elements, into nuts, small fittings, sleeves or ther tubular or annular fasteners or coupling devices distinguished by utilitarian exterior and/or interior surface portions comprising means defining a plurality of stations, in each of which each tubular elements must be positioned in the course of its conversion, including a receiving station and a plurality of following stations at least a portion of which are working stations, said receiving station being defined by means for receiving and retaining said tubular elements in a vertical orientations, transfer means for moving said elements from station to station while maintaining their vertical orientation, said transfer means including means for engaging a tubular element and control means for moving said engaging means to and inducing the engagement thereof to a tubular element in one of said stations for the movement of said engaging means and said element engaged thereby to the next following station, the disengagement of said engaging means from said element on deposit of said element in the next following station and the withdrawal therefrom and the return of said engaging means to the point from which it originally moved to commence its cycle of operation, said control means being constructed and arranged to maintain a course of movement of said engaging means in lines which define a rectangular pattern and fall in a common generally horizontal plane, said receiving station being comprised in part of means defining a base surface for each said tubular element delivered thereto and providing that one end of said element seats to said base surface and, as so seated, the length of said element rises upwardly therefrom and perpendicular thereto and is laterally stabilized by means forming a further part of said receiving station which is immediately over, adjacent to and in a plane spaced from said base surface part of said receiving station, a chute for delivery of said tubular elements to said receiving station, one by one, said chute comprising a downwardly inclined base oprtion the lowermost discharge end of which is smoothly extended by said base surface part of said receiving station, said base of said chute being laterally bounded by right angled side portions, the spacing and depth of said side portions being in correspondence with and complementary to the outside diameter and the axial length of the tubular elements delivered to said receiving station under the influence of gravity, the cross-section of said chute maintaining the end mounted vertical orientation of the lengths of said tubular elements in the delivery thereof and thereby presenting each tubular element delivered thereby in the same said vertical orientation, said apparatus being applied to the fabrication of cap nuts from simple short lengths of stock tubing and characterized in that the station next following said receiving station is an is an idler station and said idler station is followed by a plurality of working stations comprising forming, shaving and tapping stations in series relation, tooling provided in coaxial alignment with and normally in a vertically spaced relation to said forming station, said tooling being so formed that in the closing thereof on a tubular element in said station which is constituted by one of said short lengths of stock tubing to apply axial compression and shear forces to the respective ends of said element and inwardly step the upper end portion thereof while maintaining the original diameter of its inner wall surface the longitudinal extent thereof below said upper formed portion thereof, tooling provided in coaxial alignment and in vertically spaced relation to the so formed tubular element in each of the following working stations, the next following of said working stations being shaving stations, the tooling of which is formed to peripherally shave and produce flats on the exterior surface portion of the formed tubular element and a tapping station following said shaving stations, and the tooling in said tapping station being formed to hold the formed and shaped tubular element endwise and simultaneously provide a tapping of at least a portion of the length of the interior surface of said element in said tapping station to produce therein a thread and provide thereby for the completion of the forming of the short length of the tubing into a cap nut.

* * * * *

UNITED STATES PATENT AND TRADEMARK OFFICE

CERTIFICATE OF CORRECTION

PATENT NO. : 4,709,574

DATED : Dec. 1, 1987

INVENTOR(S) : Horn, deceased et al

It is certified that error appears in the above-identified patent and that said Letters Patent is hereby corrected as shown below:

Col. 6, line 33, insert a period following "50".

Col. 10, line 23, correct "4" to read -- 3 --,
line 68, correct "shave" to read -- have --.

Col. 12, line 7, delete "each rod see" and substitute -- See --.
line 8, insert -- Each rod -- immediately preceding "120".

Col. 20, line 29, correct "13" to read -- 2 --.

Col. 25, line 24, correct "the," to read -- , the --.

Col. 27, line 16, (claim 1, line 2) correct "fitting" to read -- fittings --,
line 20, (claim 1, line 6) correct "elements" to read -- element --,
line 56, (claim 1, line 42) correct "elements" to read --element --.

Col. 28, lines 3-4, (claim 2, lines 6-7) correct "transverse" to read -- transfer --.
line 6, (claim 2, line 9) insert -- the -- following "of",
line 10, (claim 2, line 13) insert -- in -- following "therein",
line 18, (claim 3, line 6) correct "elements" to read -- element --,

UNITED STATES PATENT AND TRADEMARK OFFICE

CERTIFICATE OF CORRECTION

PATENT NO. : 4,709,574

DATED : Dec. 1, 1987

INVENTOR(S) : Horn, deceased et al

It is certified that error appears in the above-identified patent and that said Letters Patent is hereby corrected as shown below:

Col. 29, line 29, (claim 5, line 4) correct "elements" to read -- element --,
line 50, (claim 7, line 5) correct "plurality" to read -- plurality --.

Col. 30, line 6, (claim 7, line 29) insert -- means -- following "engaging",
line 18, (claim 3, line 3) correct "ther" to read -- other --,
line 21, (claim 8, line 6) correct "elements" to read -- element --,
line 27, (claim 8, line 12) correct "orientations" to read -- orientation --,
lines 54-55, (claim 8, lines 39-40) correct "oprtin" to read -- portion --.

Col. 31, line 2, (claim 8, line 55) delete "is an" (first occurence).

UNITED STATES PATENT AND TRADEMARK OFFICE

CERTIFICATE OF CORRECTION

PATENT NO. : 4,709,574

DATED : Dec. 1, 1987

INVENTOR(S) : Horn, deceased et al

It is certified that error appears in the above-identified patent and that said Letters Patent is hereby corrected as shown below:

Col. 4, line 27, correct "8" to read -- 7 --,
line 43, correct "1" to read -- 2 --.

Col. 17, line 29, correct "15" to read -- 115 --.

Col. 21, line 50, correct "236" to read -- 246 --.

Col. 25, line 5, insert -- be -- following "not".

Signed and Sealed this

Twenty-fourth Day of May, 1988

*Attest:*

DONALD J. QUIGG

*Attesting Officer*

*Commissioner of Patents and Trademarks*